US008919353B2

(12) United States Patent
Richardson

(10) Patent No.: US 8,919,353 B2
(45) Date of Patent: Dec. 30, 2014

(54) HAIR BRUSH SYSTEMS

(76) Inventor: Aline D. Richardson, Prescott, AZ (US)

( * ) Notice: Subject to any disclaimer, the term of this patent is extended or adjusted under 35 U.S.C. 154(b) by 0 days.

(21) Appl. No.: 12/801,619

(22) Filed: Jun. 17, 2010

(65) Prior Publication Data

US 2010/0300470 A1 Dec. 2, 2010

Related U.S. Application Data

(63) Continuation of application No. 12/471,426, filed on May 25, 2009, now abandoned, which is a continuation-in-part of application No. 11/559,838, filed on Nov. 14, 2006, now abandoned.

(60) Provisional application No. 60/737,662, filed on Nov. 15, 2005.

(51) Int. Cl.

| | |
|---|---|
| ***A45D 24/16*** | (2006.01) |
| ***A46B 5/00*** | (2006.01) |
| ***A46B 15/00*** | (2006.01) |
| ***A47F 7/00*** | (2006.01) |

(52) U.S. Cl.

CPC ..... *A45D 24/16* (2013.01); *A46B 5/0095* (2013.01); *A46B 15/0091* (2013.01); *A47F 7/00* (2013.01); *A46B 2200/104* (2013.01)

USPC ..... 132/237

(58) Field of Classification Search

USPC ..... 132/237, 226, 261, 262, 313; 15/145, 15/176.6, 176.1; 220/574.1, 562; 206/557, 206/558, 562–565, 249, 362–362.4, 581, 206/823; 211/26.2, 70.6, 65; 219/222, 231, 219/238

See application file for complete search history.

(56) References Cited

U.S. PATENT DOCUMENTS

| | | | | |
|---|---|---|---|---|
| 1,966,734 | A * | 7/1934 | Samuel | 211/70.1 |
| 3,967,630 | A * | 7/1976 | Zuhlsdorff et al. | 132/262 |
| 3,973,528 | A | 8/1976 | Walter et al. | |
| 4,032,747 | A | 6/1977 | Kunz | |
| 4,319,594 | A | 3/1982 | Parker | |
| 4,473,086 | A * | 9/1984 | Thaler et al. | 132/229 |
| 4,623,779 | A | 11/1986 | Raab | |
| D324,454 | S | 3/1992 | Herron | |
| 5,318,052 | A | 6/1994 | Ivanov | |
| 5,337,765 | A | 8/1994 | Wong | |
| 5,427,120 | A | 6/1995 | Wong | |
| 5,435,328 | A | 7/1995 | Grohoske | |
| 5,479,951 | A | 1/1996 | Denebeim | |

(Continued)

FOREIGN PATENT DOCUMENTS

| | | |
|---|---|---|
| GB | 2172201 A | 9/1986 |
| KR | 20-0175525 | 3/2000 |

*Primary Examiner* — Todd Manahan
*Assistant Examiner* — Brianne Kalach
(74) *Attorney, Agent, or Firm* — Steptoe & Johnson LLP

(57) ABSTRACT

Hairbrushes having removable handles, kits, methods of use, and methods of sale are provided. The hairbrushes attach to the handles with a rod-and-socket quick-release system that provides a single-button quick-release coupler between a hair brush and a hair brush handle. The system facilitates easier hair curling using the brushes to curl up the hair and then releasing the handle to allow the brush to remain in the hair. The kits comprise brush-heads, at least one handle, and a container. The method involves creating a hairstyle for a customer using the brushes and then providing the customer a custom kit of the same types of brushes for use at home.

17 Claims, 14 Drawing Sheets

(56) References Cited

U.S. PATENT DOCUMENTS

| | | | | | |
|---|---|---|---|---|---|
| 5,526,829 | A | | 6/1996 | Smith | |
| 5,749,115 | A | | 5/1998 | Franke | |
| 5,765,253 | A | | 6/1998 | Martinez | |
| 5,887,600 | A | * | 3/1999 | Wilk | 132/262 |
| 5,954,064 | A | | 9/1999 | Motherhead | |
| 5,975,091 | A | | 11/1999 | Balanchi | |
| 5,992,423 | A | | 11/1999 | Tevolini | |
| 6,029,307 | A | * | 2/2000 | Baudoin | 15/145 |
| 6,067,724 | A | * | 5/2000 | Depoyian | 34/97 |
| 6,070,597 | A | | 6/2000 | Motherhead | |
| 6,230,716 | B1 | | 5/2001 | Minoletti | |
| 6,502,585 | B1 | | 1/2003 | Mazzei et al. | |
| 7,296,580 | B1 | * | 11/2007 | Sbardella | 132/122 |
| 7,654,269 | B1 | | 2/2010 | Boyle | |
| 8,051,525 | B2 | | 11/2011 | Bernat Bernat | |
| 8,220,100 | B2 | | 7/2012 | Diamond | |
| 2003/0233734 | A1 | * | 12/2003 | McGuyer et al. | 16/430 |
| 2005/0121049 | A1 | | 6/2005 | Rizzuto, Jr. | |
| 2005/0139226 | A1 | | 6/2005 | Kampel | |
| 2008/0202545 | A1 | | 8/2008 | Purvis et al. | |
| 2009/0217935 | A1 | | 9/2009 | Akerman | |
| 2009/0229624 | A1 | | 9/2009 | Richardson et al. | |

* cited by examiner

HAIR BRUSH SYSTEMS

CROSS-REFERENCE TO RELATED APPLICATION

The present application is a continuation-in-part of related application Ser. No. 11/559,838, filed Nov. 14, 2006, entitled "HAIR BRUSH SYSTEMS" which is related to and claims priority from prior provisional application Ser. No. 60/737,662, filed Nov. 15, 2005, entitled "HAIR BRUSH SYSTEMS", the contents of all of which are incorporated herein by this reference and are not admitted to be prior art with respect to the present invention by the mention in this cross-reference section.

BACKGROUND

The present invention relates to hair brush systems. More particularly, the present invention relates to a hair grooming system especially useful for curling hair. Even more particularly, the present invention relates to novel systems for hair brush displays and sales.

Many individuals strive to look fashionable and well groomed through a modification of hairstyle. In this pursuit, a significant amount of time, effort, and money are spent by individuals attempting to, for example, add curl to their hair. Conventional curling methods, although moderately effective, can be time consuming and expensive. A need exists for a simple, convenient, and effective hair curling system.

OBJECTS AND FEATURES OF THE INVENTION

A primary object and feature of the present invention is to provide a system overcoming the above-mentioned problem. A primary object and feature of the present invention is to provide hair brush systems.

It is a further object and feature of the present invention to provide such a system having a single-button quick-release coupler between a hair brush and a hair brush handle. It is another further object and feature of the present invention to provide such a system having a quick-release rod-and-socket attachment between the hairbrushes and the hairbrush handles. It is another further object and feature of the present invention to provide such a system useful for assisting hair curling.

It is a further object and feature of the present invention to provide such a system comprising a method for making and selling custom kits of hairbrushes with removable handles for curling hair. It is a further object and feature of the present invention to provide such a system comprising a method of providing clients with custom hairbrush kits adapted to the customer's personal hairstyle.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a hair brush system related to grooming of hair by a user, such system comprising: at least one brush having a plurality of bristles structured and arranged to assist such grooming of the hair; at least one handle structured and arranged to assist handle manipulation of such at least one brush by the user; and at least one coupler structured and arranged to couple such at least one brush and such at least one handle; wherein such at least one handle comprises at least one grippable surface structured and arranged to allow a hand of the user to grip such at least one handle; wherein such at least one coupler comprises at least one rotation blocker structured and arranged to block rotation of such at least one brush relative to such at least one handle during such coupling, and at least one decoupler structured and arranged to assist decoupling of such at least one brush from such at least one handle by the user; wherein such at least one decoupler comprises a digit-controlled actuator structured and arranged to allow actuation of such at least one user-controllable decoupler by a single digit of the hand; wherein such at least one digit-controlled actuator is positioned to enable such actuation without releasing such grip of such at least one handle by the hand of the user.

Moreover, it provides such a hair brush system, wherein: such at least one digit-controlled actuator is positioned within such at least one handle; and such positioning allows such actuation by a thumb of the hand. Additionally, it provides such a hair brush system, wherein at least one rotation blocker comprises projecting from such at least one handle, at least one non-circular post structured and arranged to engage at least one non-circular socket; and within such at least one brush, such at least one non-circular socket structured and arranged to receive such at least one non-circular post. Also, it provides such a hair brush system wherein: such at least one non-circular post is engageable within such at least one non-circular socket by rotating such at least one non-circular post to at least one position of alignment with such at least one non-circular socket; and such at least one position of alignment is achievable by a relative rotation of not more than about 60 degrees.

In addition, it provides such a hair brush system wherein such at least one non-circular post and such at least one non-circular socket each comprises a multi-sided polygonal geometry. And, it provides such a hair brush system wherein such at least one non-circular post and such at least one non-circular socket each comprises a hexagonal geometry. Further, it provides such a hair brush system, wherein: such at least one brush comprises at least one substantially cylindrical shape; such plurality of bristles are distributed substantially about such at least one substantially cylindrical shape; and such at least one substantially cylindrical shape is structured and arranged to assist the user impart to the hair at least one shaped curl. Even further, it provides such a hair brush system, further comprising: at least one container to contain such at least one brush; wherein such at least one container comprises at least one tray; and wherein such at least one brush comprises at least one first tray connector adapted to removeably connect such at least one brush to such at least one tray.

Moreover, it provides such a hair brush system, wherein such at least one tray further comprises: at least one second tray connector adapted to removeably connect such at least one handle to such at least one tray; wherein such at least one second tray connector is structured and arranged to engage such at least one non-circular socket of such at least one handle. Additionally, it provides such a hair brush system, wherein such at least one coupler further comprises: at least one rod having at least one longitudinal axis and at least one circumferential groove; at least one rod-receiving bore structured and arranged to receive such at least one rod; and at least one keeper structured and arranged to keep such one rod in at least one position of engagement within such at least one rod-receiving bore; wherein such at least one keeper comprises at least one automatic engager structured and arranged to automatically engage such at least one circumferential groove to prevent axial movement of such at least one rod parallel with such at least one longitudinal axis; and wherein such one digit-controlled actuator of such at least one decoupler is structured and arranged to disengage such at least one keeper from such at least one circumferential groove to allow axial movement of such at least one rod away from such at least one rod-receiving bore. Also, it provides such a hair brush system, wherein such at least one engager is further structured and arranged to permit such engagement on such at least one rod without manipulating such one digit-controlled actuator.

In addition, it provides such a hair brush system, wherein: such at least one handle comprises such at least one rod-receiving bore; such at least one rod-receiving bore is located substantially coaxially with such at least one non-circular socket; such at least one brush comprises such at least one rod; and such at least one rod projects outwardly from such at least one non-circular post. And, it provides such a hair brush system, further comprising at least one additional brush having a plurality of bristles structured and arranged to assist grooming of the hair. Further, it provides such a hair brush system, wherein: such at least one brush comprises at least one first outer diameter; and such at least one additional brush comprises at least one second outer diameter differing from such at least one first outer diameter. In accordance with another preferred embodiment hereof, this invention provides a hair brush kit comprising: a plurality of brushes adapted to brush hair; at least one handle adapted to handle such plurality of brushes wherein such at least one handle comprises at least one quick-connect coupler adapted to securely connect at least one of such plurality of brushes to such at least one handle; and at least one quick-connect releaser adapted to release such at least one at least one quick-connect coupler; and at least one container adapted to contain such plurality of brushes and such at least one handle.

Even further, it provides such a hair brush kit, further comprising at least one rotation preventer structured and arranged to prevent axial rotation between such at least one handle and at least one of such plurality of brushes when such at least one of such plurality of brushes is connected to such at least one handle. Moreover, it provides such a hair brush kit, wherein each of such plurality of brushes comprises at least one container connector adapted to connect each of such plurality of brushes to such at least one container. Additionally, it provides such a hair brush kit, wherein: such at least one container comprises a plurality of holes; and such at least one container connector comprises at least one peg adapted to fit connectively into at least one of such plurality of holes. Also, it provides such a hair brush kit, wherein such plurality of brushes comprises at least one brush comprising at least one first diameter and at least one brush comprising at least one second diameter.

In addition, it provides such a hair brush kit wherein: such at least one container comprises at least one tray; and a plurality of such at least one trays are structured and arranged to interlock with each other. In accordance with another preferred embodiment hereof, this invention provides a hair brush point-of-sale display, comprising: a plurality of brushes adapted to brush hair; a plurality of handles each adapted to removably connect to such plurality of brushes; and a plurality of containers each adapted to contain a portion of such plurality of brushes and a portion of such plurality of handles; wherein each of such plurality of brushes comprises at least one container connector adapted to connect each of such plurality of brushes to at least one of such plurality of containers; wherein such plurality of containers comprises a plurality of trays; and wherein such plurality of trays are structured and arranged to interlock with each other. And, it provides such a hair brush point-of-sale display, wherein: such plurality of containers each comprise a plurality of holes; and such at least one container connector comprises at least one peg adapted to fit connectively into at least one of such plurality of holes. Further, it provides such a hair brush point-of-sale display, wherein such plurality of brushes comprises at least one brush comprising at least one first diameter and at least one brush comprising at least one second diameter. In accordance with another preferred embodiment hereof, this invention provides a hair brush sales method, comprising the steps of: styling at least one customer's hair into at least one hairstyle using a plurality of brushes having detachable handles; identifying the types of brushes having detachable handles used to style such at least one customer's hair; selecting new brushes of the same types as the brushes used to style such at least one customer's hair; and selling such new brushes to such at least one customer. Even further, it provides such a hair brush sales method, further comprising the steps of selecting at least one detachable handle adapted to handle such new brushes and selling such at least one detachable handle to such at least one customer. Even further, it provides such a hair brush sales method further comprising the step of selling at least one container for such new brushes to such at least one customer. Even further, it provides such a hair brush sales method, further comprising the step of compiling at least one kit comprising such new brushes, at least one detachable handle, and at least one container and selling such at least one kit to such at least one customer.

In accordance with a preferred embodiment hereof, this invention provides a hair brush system, comprising: brush means for brushing hair; handle means for handling such brush means; quick-release connector means for securely quick-release-connecting such brush means to such handle means; and quick releaser means for releasing such quick-release connector means.

In accordance with a preferred embodiment hereof, this invention provides a hair brush system, comprising: at least one brush adapted to brush hair; at least one handle adapted to handle such at least one brush; at least one quick-release connector adapted to securely quick-release-connect such at least one brush to such at least one handle; and at least one quick releaser adapted to release such at least one quick-release connector.

Moreover, it provides such a hair brush system, wherein such at least one quick-release connector comprises at least one spring-biaser adapted to spring-bias such at least one quick-release connector in at least one gripping configuration. Additionally, it provides such a hair brush system, wherein such at least one quick releaser comprises at least one spring-bias releaser adapted to release such at least one spring-biaser. Also, it provides such a hair brush system, further comprising at least one spin-resister adapted to resist such at least one brush spinning on such at least one handle. In addition, it provides such a hair brush system, wherein such at least one brush comprises at least one curler adapted to curl hair.

And, it provides such a hair brush system, further comprising at least one container adapted to contain such at least one brush. Further, it provides such a hair brush system, wherein such at least one container comprises at least one tray. Even further, it provides such a hair brush system, wherein such at least one brush comprises at least one container connector adapted to connect such at least one brush to such at least one container. Moreover, it provides such a hair brush system, wherein such at least one brush is substantially cylindrical.

Additionally, it provides such a hair brush system, wherein such at least one quick-release connector comprises: at least one rod; at least one clamp structured and arranged to clamp upon such at least one rod; and at least one spring structured and arranged to hold such at least one clamp clamped upon such at least one rod. Also, it provides such a hair brush system, wherein such at least one quick releaser comprises at least one rotator structured and arranged to rotate such at least one clamp wherein such at least one clamp is unclamped from such at least one rod. In addition, it provides such a hair brush system, wherein such at least one rod comprises at least one catch structured and arranged to prevent such at least one rod from being pulled longitudinally out of such at least one clamp when such at least one clamp is clamped upon such at least one rod.

In accordance with another preferred embodiment hereof, this invention provides a hair brush kit, comprising: a plurality of brushes adapted to brush hair; at least one handle adapted to handle such plurality of brushes wherein such at least one handle comprises at least one quick-release connector adapted to securely quick-release-connect such plurality of brushes to such at least one handle; and at least one quick releaser adapted to release such at least one quick-release connector; and at least one container adapted to contain such plurality of brushes and such at least one handle.

And, it provides such a hair brush kit, further comprising at least one rotation preventer structured and arranged to prevent axial rotation between such at least one handle and at least one of such plurality of brushes when such at least one of such plurality of brushes is connected to such at least one handle. Further, it provides such a hair brush kit, wherein each of such plurality of brushes comprises at least one container connector adapted to connect each of such plurality of brushes to such at least one container.

Even further, it provides such a hair brush kit, wherein such at least one container comprises a plurality of holes; and wherein such at least one container connector comprises at least one peg adapted to fit connectively into at least one of such plurality of holes. Moreover, it provides such a hair brush kit, wherein such plurality of brushes comprises at least one brush comprising at least one first diameter and at least one brush comprising at least one second diameter. Additionally, it provides such a hair brush point-of-sale display, wherein such at least one container comprises at least one tray. Also, it provides such a hair brush point-of-sale display, wherein a plurality of such at least one trays are structured and arranged to interlock with each other.

In accordance with another preferred embodiment hereof, this invention provides a hair brush point-of-sale display, comprising: a plurality of brushes adapted to brush hair; a plurality of handles each adapted to removably connect to such plurality of brushes; and a plurality of containers each adapted to contain a portion of such plurality of brushes and a portion of such plurality of handles.

In addition, it provides such a hair brush point-of-sale display, wherein each of such plurality of brushes comprises at least one container connector adapted to connect each of such plurality of brushes to at least one of such plurality of containers. And, it provides such a hair brush point-of-sale display, wherein such plurality of containers comprises a plurality of trays. Further, it provides such a hair brush point-of-sale display, wherein such plurality of trays are structured and arranged to interlock with each other. Even further, it provides such a hair brush point-of-sale display, wherein such plurality of containers each comprise a plurality of holes; and wherein such at least one container connector comprises at least one peg adapted to fit connectively into at least one of such plurality of holes. Even further, it provides such a hair brush point-of-sale display, wherein such plurality of brushes comprises at least one brush comprising at least one first diameter and at least one brush comprising at least one second diameter.

In accordance with another preferred embodiment hereof, this invention provides a hair brush sales method, comprising the steps of: styling at least one customer's hair into at least one hairstyle using a plurality of brushes having detachable handles; identifying the types of brushes having detachable handles used to style such at least one customer's hair; selecting new brushes of the same types as the brushes used to style such at least one customer's hair; and selling such new brushes to such at least one customer.

Even further, it provides such a hair brush sales method, further comprising the steps of selecting at least one detachable handle adapted to handle such new brushes and selling such at least one detachable handle to such at least one customer. Even further, it provides such a hair brush sales method, further comprising the step of selling at least one container for such new brushes to such at least one customer. Even further, it provides such a hair brush sales method; further comprising the step of compiling at least one kit comprising such new brushes, at least one detachable handle, and at least one container and selling such at least one kit to such at least one customer. Even further, it provides such a hair brush sales method, further comprising the step of inserting at least one portion of such new brushes into holes in such at least one container for storage.

In accordance with another preferred embodiment hereof, this invention provides a hair brush system, comprising: at least one brush adapted to brush hair; at least one handle structured and arranged to handle such at least one brush; wherein such at least one handle is attachable to and detachable from such at least one brush; and at least one container adapted to contain such at least one brush and such at least one handle; wherein such at least one container comprises a plurality of holes; wherein such at least one brush is structured and arranged to fit connectively into at least one of such plurality of holes; and wherein such at least one handle is structured and arranged to fit connectively into at least one of such plurality of holes. Even further, it provides such a hair brush system, wherein such at least one container comprises at least one tray.

DETAILED DESCRIPTION OF THE BEST MODES AND PREFERRED EMBODIMENTS OF THE INVENTION

Figure 1:
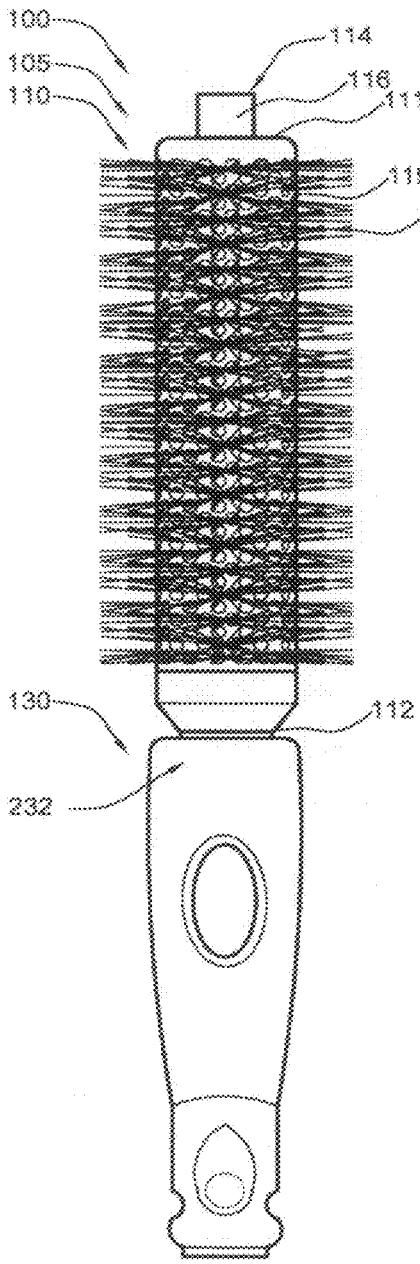
FIG. 1 shows a front view illustrating a hair brush according to a preferred embodiment of the present invention.
Figure 2:
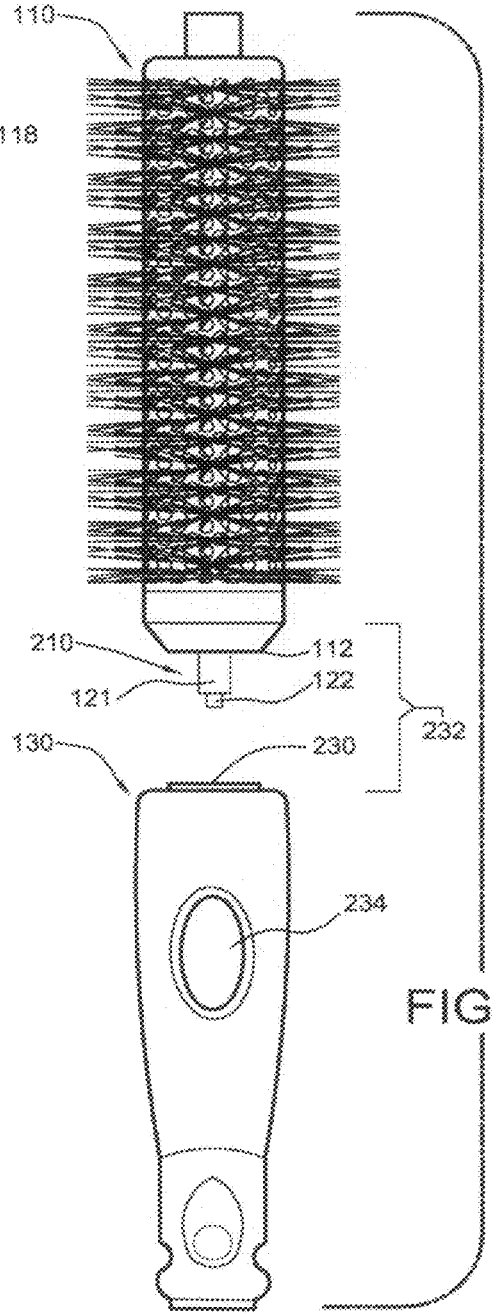
FIG. 2 shows a front view illustrating the hair brush of FIG. 1 disassembled into a handle and a brush.

FIG. 1 shows a front view illustrating hair brush 105 according to a preferred embodiment of the present invention. Hair brush system 100 preferably comprises hairbrush 105, as shown. Hairbrush 105 preferably comprises two principal components identified herein as brush 110 and handle 130, as shown. Handle 130 is preferably detachable from brush 110, as shown in FIG. 2. Hairbrushes 105 are preferably used to style hair 50 by placing brushes 110 in hair 50 as "curlers", preferably while blow-drying the hair (see FIG. 12). Preferably, multiple brushes 110 of varying diameters are used in order to create unique hairstyles. The system facilitates easier hair curling by using the brush 110 to curl up the hair 50 and then releasing the handle 130 to allow the brush 110 to remain in the hair 50 setting the curl. Re-attachment of the handle may then be used to assist removal of the brush 110.

Brush 110 preferably comprises bristles 118, as shown, to assist grooming of hair 50 (at least embodying herein at least one brush having a plurality of bristles structured and arranged to assist grooming of the hair). Brush 110 preferably comprises brush-head 119, as shown. Preferably, brush 110 comprises end 111 and end 112, as shown. Bristles 118 preferably comprise nylon bristles. Preferably, brush-head 119 comprises a perforated hollow cylindrical barrel having at least one ceramic heat-retaining coating. Upon reading the teachings of this specification, those with ordinary skill in the art will now understand that, under appropriate circumstances, considering such issues as advances in technology, user preference, intended hairstyle, manufacturing costs, etc., other types of brushes, such as flat brushes, spherical brushes, oval brushes, combs, curlers without bristles, other types of bristles, etc., may suffice.

Figure 8:
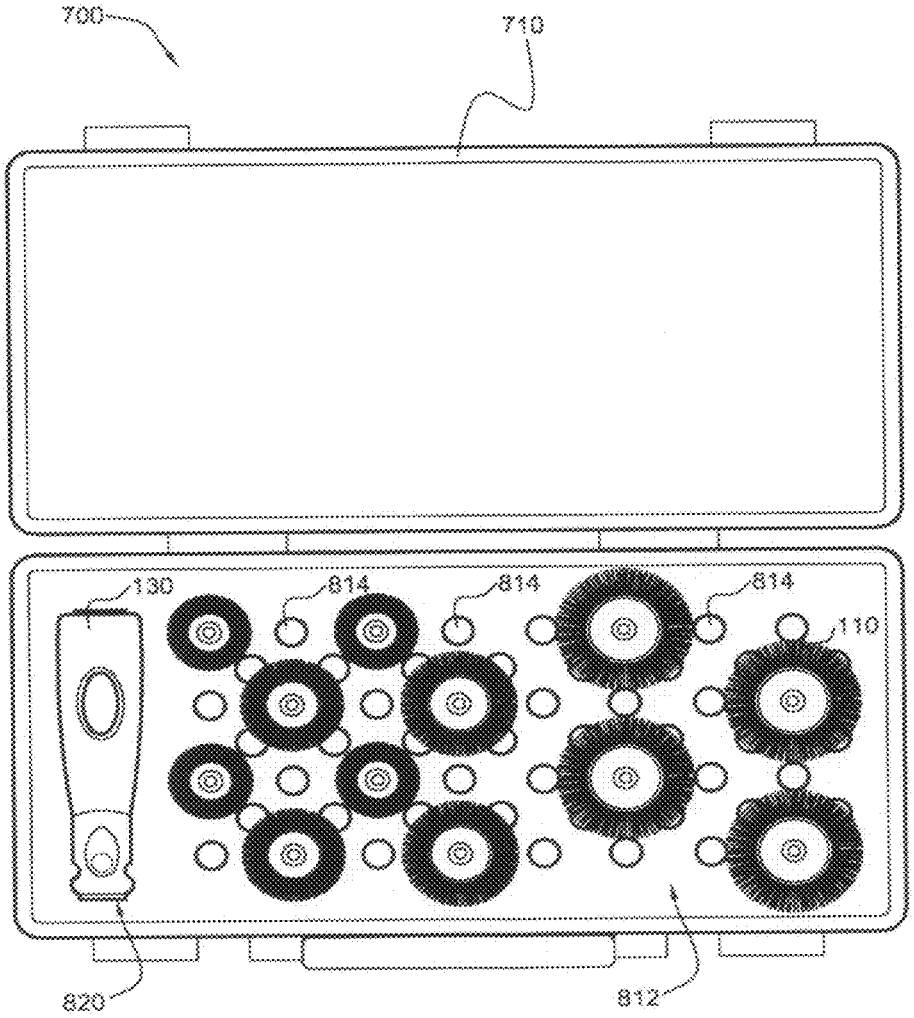
FIG. 8 shows a top view illustrating the kit of FIG. 7 fully assembled.

Preferably, brush 110 comprises connector 114 on end 111, as shown. Preferably, connector 114 comprises peg 116, as shown. For durability during use, peg 116 preferably comprises metal. Preferably, connector 114 removably attaches brush 110 to container 700, as shown in FIG. 8. Upon reading the teachings of this specification, those with ordinary skill in the art will now understand that, under appropriate circumstances, considering such issues as advances in technology, user preference, etc., other connectors, such as slots, clips, fittings, other peg shapes, other peg materials, magnets, etc., may suffice.

Figure 3:
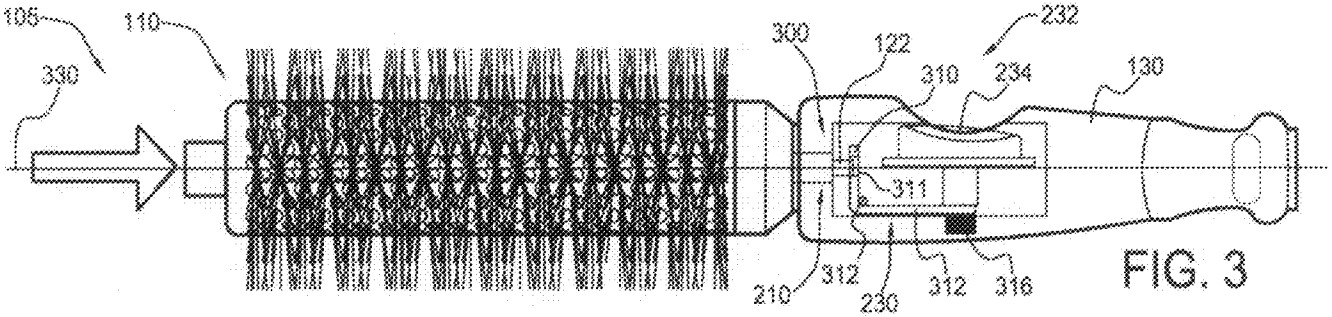
FIG. 3 shows a side view illustrating the attachment mechanism of the hair brush of FIG. 1 during handle insertion.
Figure 4:
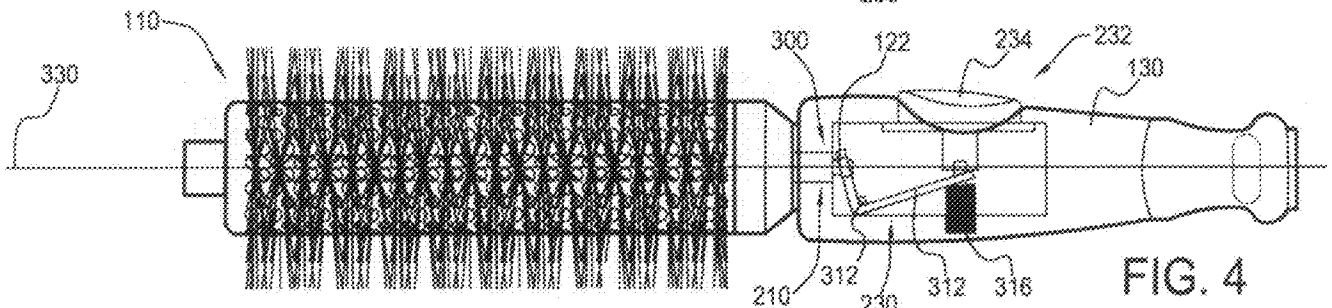
FIG. 4 shows a side view illustrating the attachment mechanism of the hair brush of FIG. 1 during use.
Figure 5:
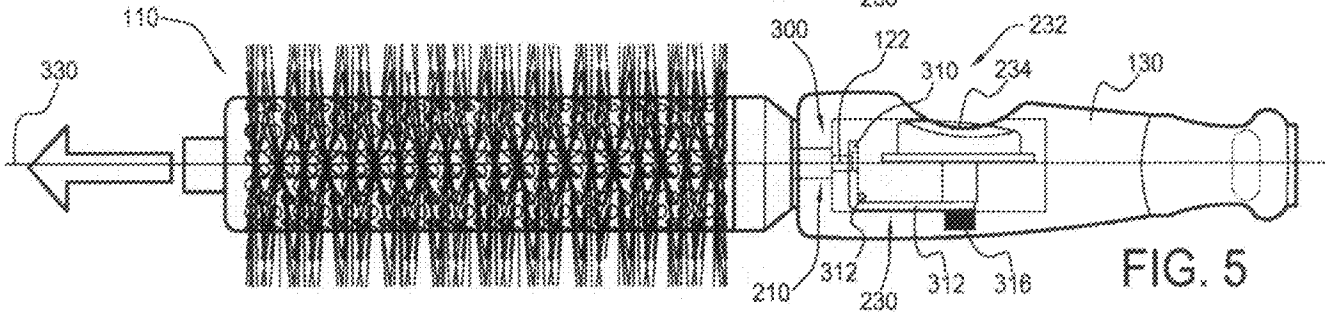
FIG. 5 shows a side view illustrating the attachment mechanism of the hair brush of FIG. 1 during handle removal.

FIG. 2 shows a front view, illustrating hairbrush 105 according to FIG. 1, in a disassembled arrangement comprising handle 130 separated from brush 110. Handle 130 preferably comprises attacher 230, as shown. Preferably, attacher 230 comprises quick-coupler 232, as shown in FIG. 3. Preferably, quick-coupler 232 comprises quick-coupler releaser 234, as shown. Preferably, quick-coupler releaser 234 releases quick-coupler 232 from at least one locked position to at least one unlocked position, as shown in FIGS. 3-5. Upon reading the teachings of this specification, those with ordinary skill in the art will now understand that, under appropriate circumstances, considering such issues as advances in technology, user preference, etc., other handle components, such as a means for heating the brush, a means for blowing air into the brush, a means for applying styling products to the brush, etc., may suffice.

Preferably, brush 110 comprises attacher 210 on end 112, as shown. Preferably, attacher 120 comprises rod 122, as shown. Preferably, attacher 120 comprises rod support 121, as shown. Preferably, rod 122 comprises metal. Preferably, attacher 210 attaches to attacher 230, as shown in FIG. 4. Preferably, quick-coupler 232 attaches to rod 122, as shown in FIG. 4. Upon reading the teachings of this specification, those with ordinary skill in the art will now understand that, under appropriate circumstances, considering such issues as advances in technology, user preference, manufacturing considerations, intended use, etc., other attachers, such as hook and loop fasteners, magnets, other clamps, friction fittings, other rotationally indexed connectors, other types of actuators, etc., may suffice.

FIG. 3 shows a side view illustrating attacher 230 of hairbrush 105 of FIG. 1 during handle 130 insertion. Preferably, attacher 210 and attacher 230 together comprise attacher 300, as shown. Preferably, quick-coupler 232 comprises clamp 310, lever 312, fulcrum 314, spring 316, and quick-coupler releaser 234, as shown. Preferably, fulcrum 314 holds clamp 310 and lever 312 while permitting clamp 310 and lever 312 to rotate about fulcrum 314, as shown. Preferably, clamp 310 and lever 312 comprise one continuous piece of metal bent about fulcrum 314, as shown. Upon reading the teachings of this specification, those with ordinary skill in the art will now understand that, under appropriate circumstances, considering such issues as advances in technology, user preference, ease of manufacturing, etc., other quick-coupler mechanisms, clamping mechanisms, etc., may suffice.

Preferably, clamp 310 comprises aperture 311, as shown. Preferably, clamp 310 is slightly wider than aperture 311, as shown. Preferably, clamp 310 is about one-eighths inch thick. Preferably, aperture 311 is sized and shaped to fit over rod 122, as shown. Preferably, rod 122 is about one-eighths inch in diameter. Preferably, aperture 311 is slightly larger that one-eighths inch in diameter. Preferably, aperture 311 fits over rod 122 at any angle of rotation about axis 330. Preferably, rod 122 is substantially circular, as shown in FIG. 8. Preferably, aperture 311 is substantially circular. Upon reading the teachings of this specification, those with ordinary skill in the art will now understand that, under appropriate circumstances, considering such issues as advances in technology, user preference, etc., other arrangements, such as the aperture comprising a slot, the aperture comprising a hole placed longitudinally into the end of a lever, the rod and aperture being rotationally indexed, other rod diameters, other aperture diameters, etc., may suffice.

Preferably, when quick-coupler releaser 234 is compressed, quick-coupler 232 is moved into an unlocked position, as shown. Preferably, when quick-coupler releaser 234 is compressed, aperture 311 is moved into an alignment approximately perpendicular to rod 122, whereby rod 122 is insertable into aperture 311 without binding, as shown. Preferably, when quick-coupler releaser 234 is compressed, rod 122 is insertable into aperture 311 by applying only a small amount of pressing force to rod 122, as shown. This technique is useful for quickly attaching brush 110 to handle 130 when brush 110 is in a customer's hair 50, because handle 130 can be attached to brush 110 without the necessity of the stylist holding brush 110 in his or her other hand.

Preferably, at the stylist's choice, rod 122 may be pressed into aperture 311 without the stylist compressing quick-coupler releaser 234, as shown. This technique is useful for quickly attaching brush 110 to handle 130 prior to use in a customer's hair 50.

FIG. 4 shows a side view illustrating attacher 210 of hairbrush 105 according to FIG. 1 during use. Preferably, when quick-coupler releaser 234 is released, quick-coupler 232 is moved into the locked position, as shown. Preferably, when quick-coupler releaser 234 is released, spring 316 moves aperture 311 over rod 122 (by moving lever 312 and clamp 310), as shown, and applies clamping pressure whereby rod 122 is securely held by aperture 311. Preferably, spring 316 comprises a metal coil spring.

Preferably, spring 316 provides sufficient clamping pressure that aperture 311 resists rotating about rod 122 as hair brush 105 is used. Preferably, rod 122 and/or the interior wall of aperture 311 comprise at least one slip-resistant texture. Upon reading the teachings of this specification, those with ordinary skill in the art will now understand that, under appropriate circumstances, considering such issues as advances in technology, user preference, etc., other means of preventing brush rotation, such as indexing, sloping the walls of the aperture to provide greater contact area between the aperture and the rod, applying a non-slip coating to the rod, applying a non-slip coating to the aperture, etc., may suffice.

FIG. 5 shows a side view illustrating attacher 210 of hairbrush 105 according to FIG. 1 during handle 130 removal. Preferably, when quick-coupler releaser 234 is compressed, quick-coupler 232 is moved into the unlocked position, as shown. Preferably, when quick-coupler releaser 234 is compressed (simultaneously compressing spring 316), aperture 311 is moved into an alignment approximately perpendicular to rod 122, as shown, whereby rod 122 is removable from aperture 311 without binding. Preferably, when quick-coupler releaser 234 is compressed, rod 122 (at least embodying herein at least one rod) is removable from aperture 311 by applying a minute amount of pulling force to rod 122. This technique is useful for quickly removing brush 110 from handle 130 when brush 110 is in a customer's hair, because handle 130 can be removed from brush 110 without the necessity of the stylist holding brush 110 in his or her other hand.

Figure 6:
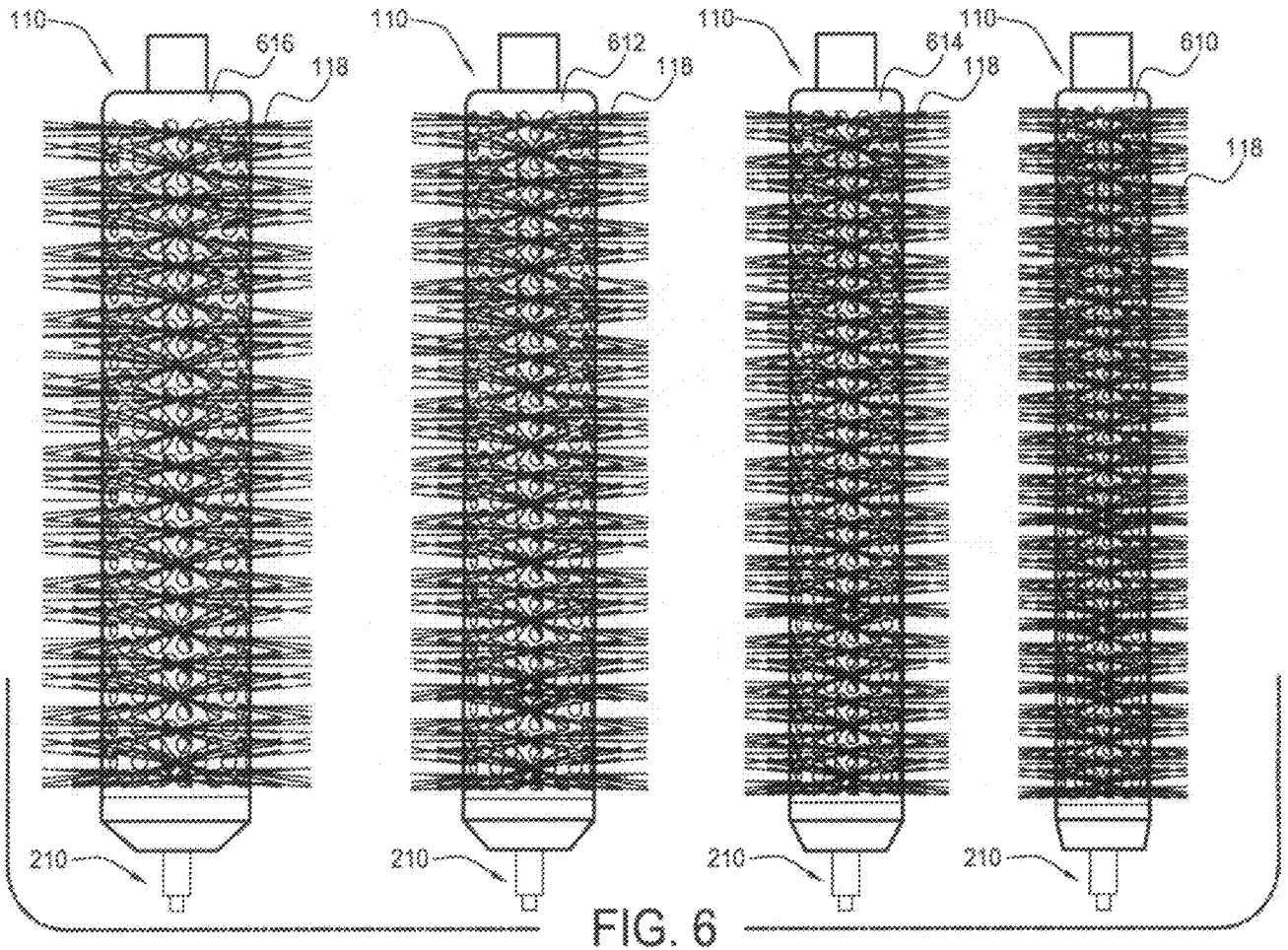
FIG. 6 shows a front view illustrating a set of brushes according to the preferred embodiment of FIG. 1.

FIG. 6 shows a front view illustrating a set of brushes 110 according to the preferred embodiment of FIG. 1. Preferably, brushes 110 comprise multiple sizes, as shown. Preferably, brushes 110 comprise smallest brush 610 and largest brush 616, as shown. Preferably, brushes 110 comprise medium brush 612, as shown. Preferably, brushes 110 comprise small brush 614, as shown.

Preferably, brushes 110 are about seven inches long. More preferably, the portion of brush 110 comprising bristles 118 is about four inches long. Preferably, largest brush 616 is about two and one half inches in diameter. Preferably, smallest brush 610 is about one inch in diameter. Preferably, brushes 110 (at least embodying herein wherein such at least one brush is substantially cylindrical) are substantially cylindrical for use as curlers, as shown. Upon reading the teachings of this specification, those with ordinary skill in the art will now understand that, under appropriate circumstances, considering such issues as advances in technology, user preference, etc., other brush sizes, shapes, bristles, combinations of sizes in a set, etc., may suffice.

Figure 7:
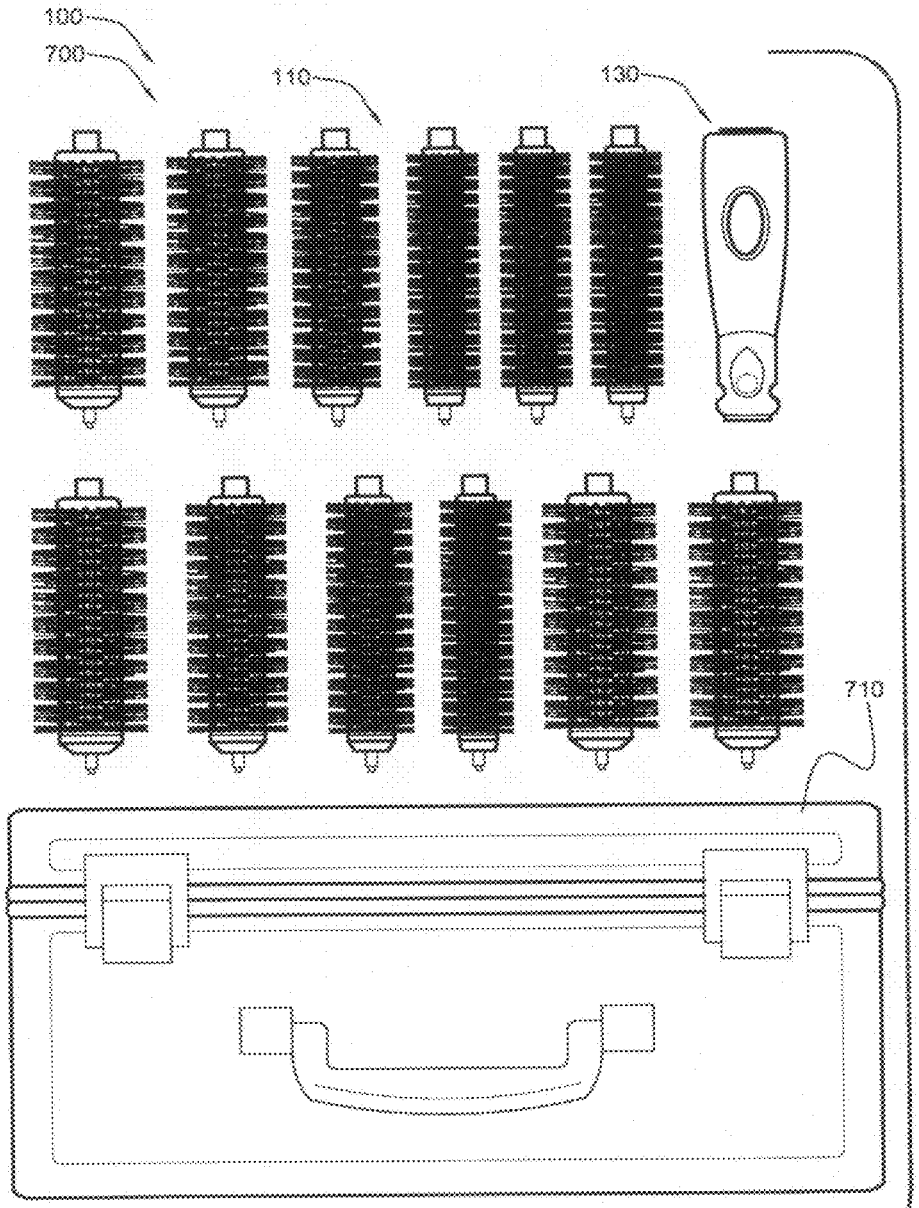
FIG. 7 shows a front view illustrating the components of a kit according to another preferred embodiment of the present invention.

FIG. 7 shows a front view illustrating the components of kit 700 according to the preferred embodiment of the present invention. Preferably, hair brush system 100 comprises kit 700, as shown. Preferably, kit 700 comprises a plurality of brushes 110 (at least embodying herein at least one brush adapted to brush hair), at least one handle 130 (at least embodying herein at least one handle adapted to handle such at least one brush), and at least one container 710, as shown. Preferably, all handles 130 attach to all brushes 110 in the same kit 700. Preferably, container 710 (at least embodying herein at least one container adapted to contain such at least one brush) is adapted to hold brushes 110 (at least embodying herein wherein such plurality of brushes comprises at least one brush comprising at least one first diameter and at least one brush comprising at least one second diameter) in a plurality of sizes and at least one handle 130, as shown. More preferably, container 710 is a closable container adapted to contain brushes 110 and handle 130, as shown. Upon reading the teachings of this specification, those with ordinary skill in the art will now understand that, under appropriate circumstances, considering such issues as advances in technology, user preference, etc., other kit components, such as user instructions, brush placement diagrams, replacement parts, hair-styling products, other hair-styling tools, brushes that selectively connect to one handle in the kit but not to another handle in the kit, etc., may suffice.

FIG. 8 shows a top view illustrating kit 700 according to FIG. 7 fully assembled. Preferably, container 710 comprises interior 812, as shown. Preferably, interior 812 comprises holes 814, as shown. Preferably, holes 814 are adapted to friction-fit onto peg 116 (at least embodying herein wherein such at least one brush comprises at least one container connector adapted to connect such at least one brush to such at least one container). Preferably, pegs 116 are inserted into holes 814 in order to conveniently hold brushes 110 in container 710.

Preferably, container 710 comprises slot 820, as shown. Preferably, slot 820 is adapted to friction-fit handle 130. Preferably, handle 130 is inserted into slot 820 for storage. Upon reading the teachings of this specification, those with ordinary skill in the art will now understand that, under appropriate circumstances, considering such issues as advances in technology, user preference, etc., other storage arrangements, such as a stand, a bag, etc., may suffice.

Figure 9:
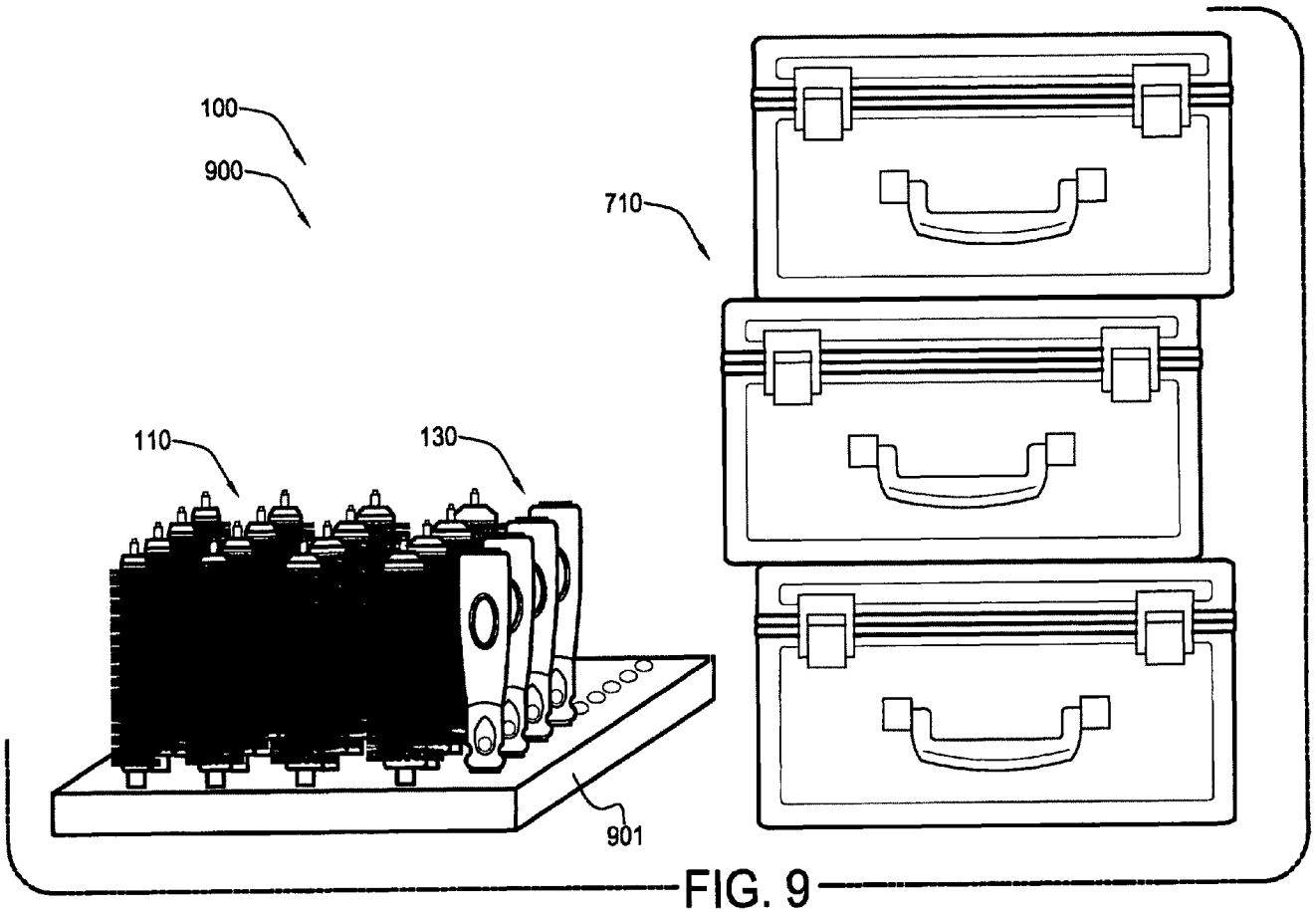
FIG. 9 shows a front view illustrating a point-of-sale display according to another preferred embodiment of the present invention.

FIG. 9 shows a front view illustrating point-of-sale display 900 according to the preferred embodiment of the present invention. Preferably, hair brush system 100 comprises display 900, as shown. Preferably, a plurality of brushes 110, a plurality of handles 130, and a plurality of containers 710 are provided to consumers in display 900, as shown. Preferably, all handles 130 attach to all brushes 110 in display 900. Preferably, display 900 further comprises display stand 901, as shown. Preferably, display stand 901 is adapted to hold at least such plurality of brushes 110 and such plurality of handles 130 in a consumer-accessible arrangement. Upon reading the teachings of this specification, those with ordinary skill in the art will now understand that, under appropriate circumstances, considering such issues as advances in technology, user preference, etc., other display components, such as styling guides, styling products, other styling tools, etc., may suffice.

Preferably, consumers select one or more brushes 110, one or more handles 130, and (preferably one) container 710 from display 900, according to type of hairstyle they wish to create. Preferably, consumers create one or more kits 700 from the components of display 900.

Figure 10:
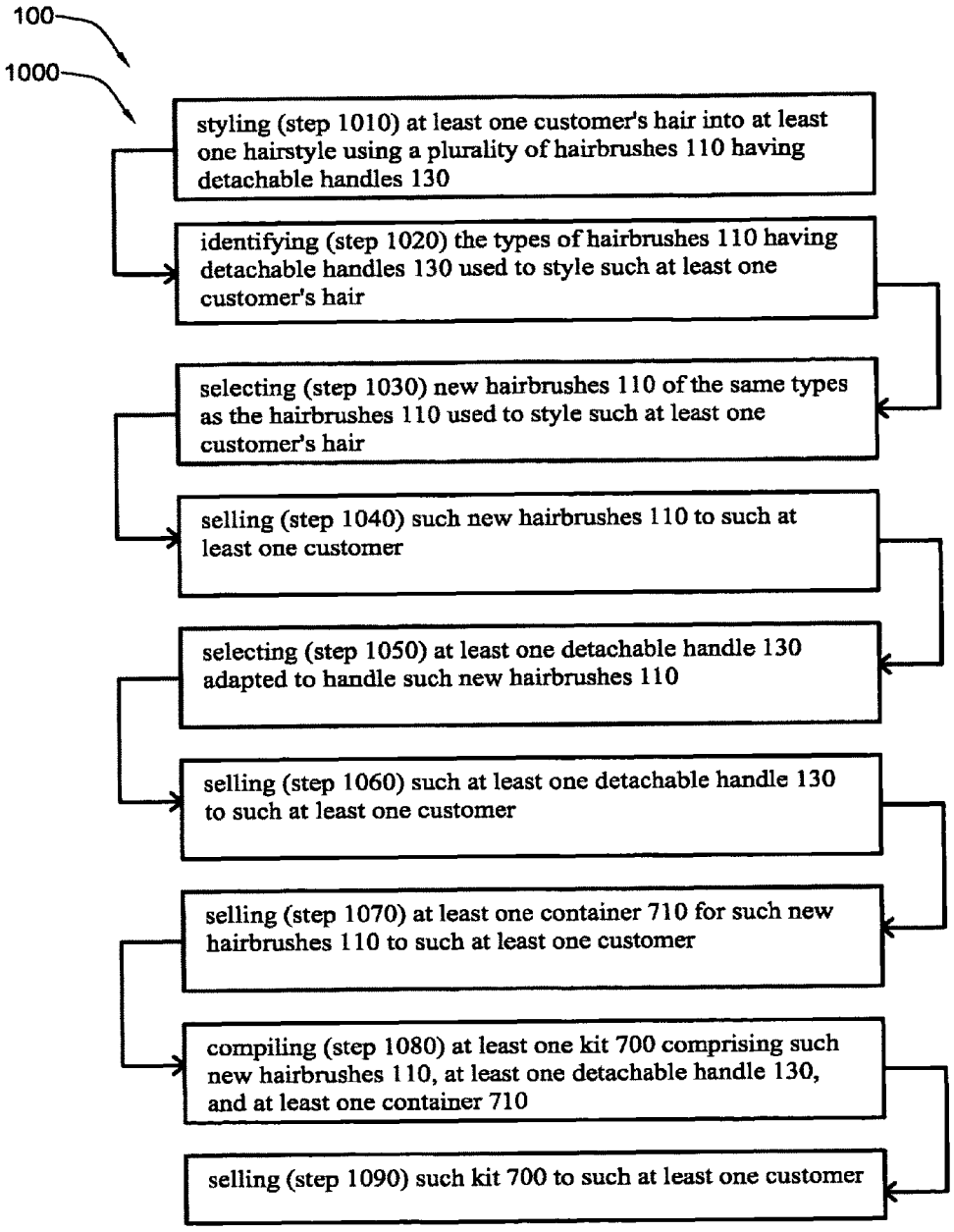
FIG. 10 shows a block diagram illustrating a method according to the preferred embodiments of the present invention.

FIG. 10 shows a block diagram of method 1000 according to the preferred embodiment of the present invention. Preferably, hair brush system 100 comprises method 1000, as shown. Preferably, method 1000 comprises the steps of: styling (step 1010) at least one customer's hair 50 into at least one hairstyle using a plurality of brushes 110 having detachable handles 130; identifying (step 1020) the types of brushes 110 having detachable handles 130 used to style such at least one customer's hair 50; selecting (step 1030) new brushes 110 of the same types as the brushes 110 used to style such at least one customer's hair; and selling (step 1040) such new brushes 110 to such at least one customer, as shown (at least embodying herein the step of styling at least one customer's hair into at least one hairstyle using a plurality of brushes having detachable handles; and at least embodying herein the step of identifying the types of brushes having detachable handles used to style such at least one customer's hair; at least embodying herein the step of selecting new brushes of the same types as the brushes used to style such at least one customer's hair; at least embodying herein the step of selling such new brushes to such at least one customer).

Preferably, method 1000 further comprises the step of selecting (step 1050) at least one detachable handle 130 adapted to handle such new brushes 110 and selling (step 1060) such at least one detachable handle 130 to such at least one customer, as shown (at least embodying herein the step of selecting at least one detachable handle adapted to handle such new brushes and selling such at least one detachable handle to such at least one customer). Preferably, method 1000 further comprises the step of selling (step 1070) at least one container 710 for such new brushes 110 to such at least one customer, as shown (at least embodying herein the step of selling at least one container for such new brushes to such at least one customer).

Preferably, method 1000 further comprises the step of compiling (step 1080) at least one kit 700 comprising such new brushes 110 (at least embodying herein a plurality of brushes adapted to brush hair), at least one detachable handle 130 (at least embodying herein a plurality of handles each adapted to removably connect to such plurality of brushes), and at least one container 710 (at least embodying herein a plurality of containers each adapted to contain a portion of such plurality of brushes and a portion of such plurality of handles) and selling (step 1090) such kit 700 to such at least one customer, as shown (at least embodying herein the step of compiling at least one kit comprising such new brushes, at least one detachable handle, and at least one container and selling such at least one kit to such at least one customer). Preferably, method 1000 assists a hairstylist to create a custom hairstyle for a customer and then provide a custom kit 700 to the customer to enable the customer to recreate the custom hairstyle at home. Upon reading the teachings of this specification, those with ordinary skill in the art will now understand that, under appropriate circumstances, considering such issues as advances in technology, user preference, intended use, changes in hairstyles, etc., other steps, such as adding new brushes to an existing kit, adding new handles to an existing kit, etc., may suffice.

Figure 11A:
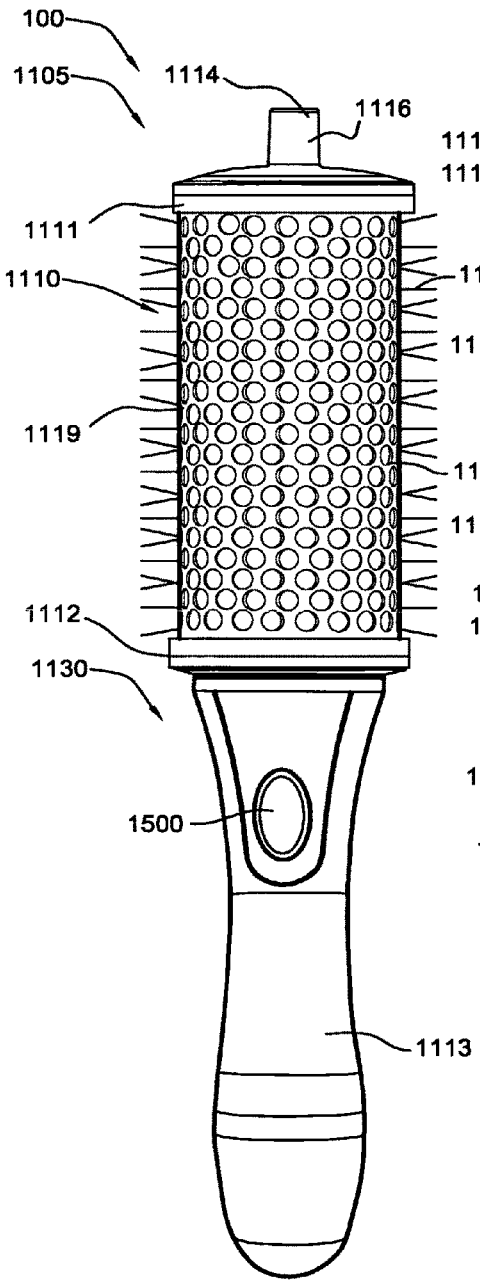
FIG. 11A shows a front view illustrating another hair brush according to an alternate preferred embodiment of the present invention.
Figure 11B:
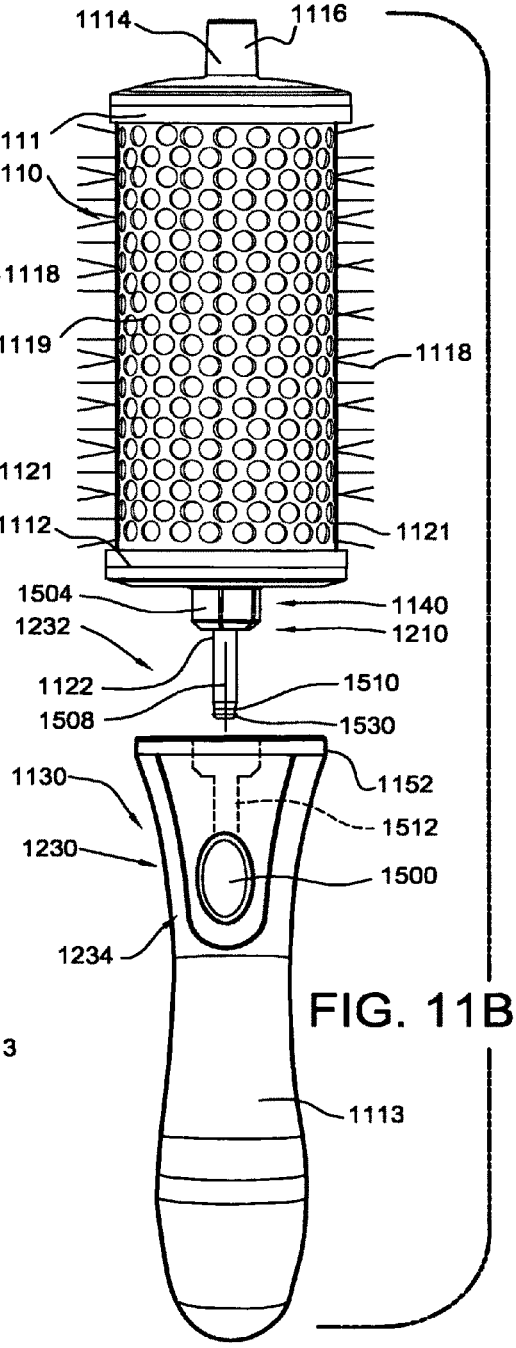
FIG. 11B shows a front view illustrating the hair brush of FIG. 11A disassembled into a handle and a brush.
Figure 12:
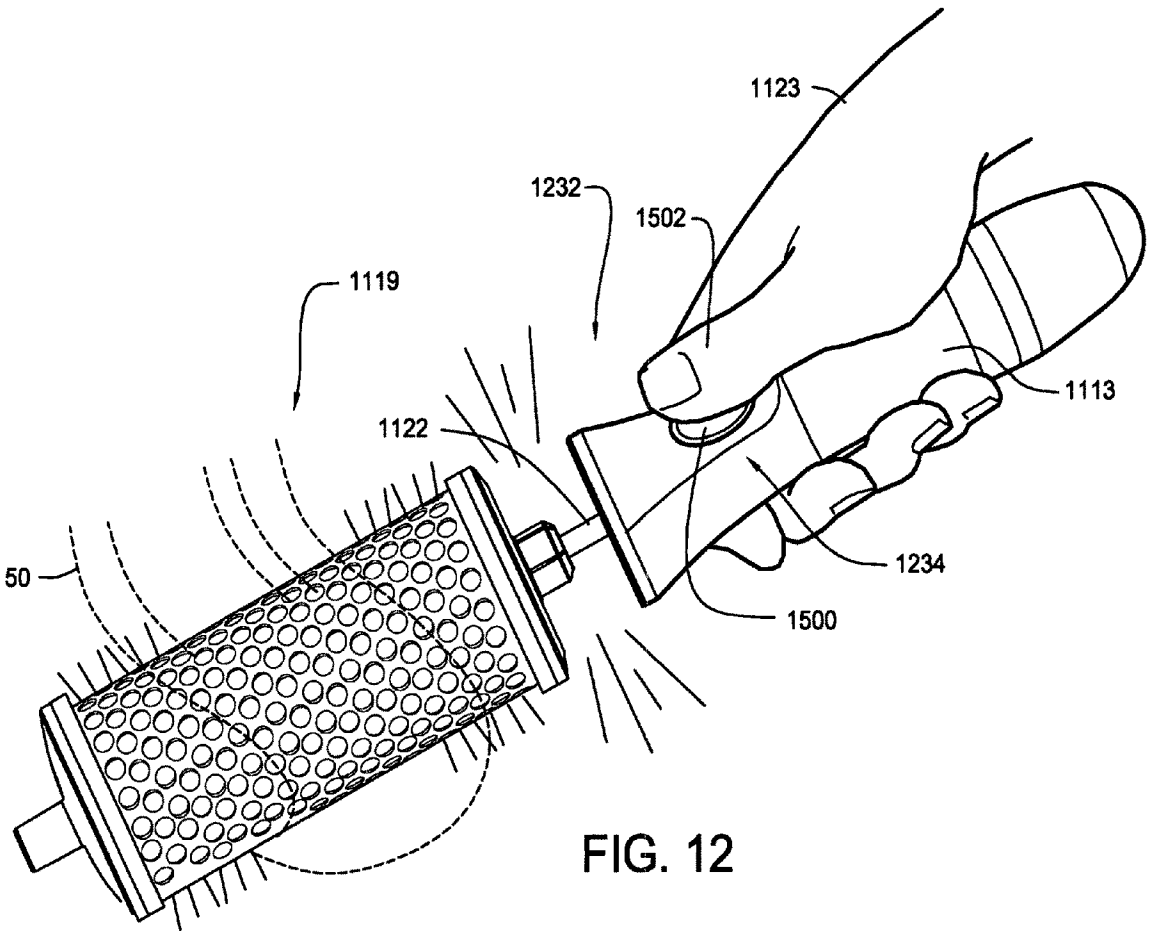
FIG. 12 shows the hair brush of FIG. 11A manipulated by a user

FIG. 11A shows a front view illustrating another hair brush 1105 according to an alternate preferred embodiment of the present invention. Preferably, hair brush system 100 comprises hair brush 1105 structured and arranged to assist grooming of the hair 50 (see FIG. 12). Hairbrush 1105 is preferably a modification of hairbrush 105, as shown. Preferably, hairbrush 1105 comprises brush 1110 and handle 1130 to assist handle manipulation of brush 1110 by the user, as shown. Preferably, handle 1130 is attachable and detachable from brush 1110, as shown in FIG. 11B and FIG. 12. Handle 1130 preferably comprises at least one grippable surface 1113 structured and arranged to allow a hand 1123 of the user to grip handle 1130, as best illustrated in FIG. 12.

Brush 1110 preferably comprises bristles 1118, as shown, as shown, to assist grooming of the hair (at least embodying herein at least one brush having a plurality of bristles structured and arranged to assist grooming of the hair). It is noted that bristles 1118 are shown diagrammatically in the present figure for clarity. Preferably, brush 1110 comprises brush-head 1119, as shown. Preferably, brush 1110 comprises top end 1111 and bottom end 1112, as shown. Brush-head 1119 preferably comprises a substantially cylindrical shape, as shown. The plurality of bristles 1118 of brush-head 1119 are preferably distributed about 360 degrees of the cylindrical shape, as shown. Preferably, brush-head 1119 comprises a perforated hollow cylindrical barrel 1121 having at least one ceramic heat-retaining coating. Such cylindrical shape of brush-head 1119 assists the user impart to the hair at least one shaped curl, as shown in FIG. 12. Upon reading the teachings of this specification, those with ordinary skill in the art will now understand that, under appropriate circumstances, considering such issues as advances in technology, user preference, intended hairstyle, manufacturing costs, etc., other types of brushes, such as flat brushes, spherical brushes, oval brushes, combs, curlers without bristles, other types of bristles, etc., may suffice.

Figure 22:
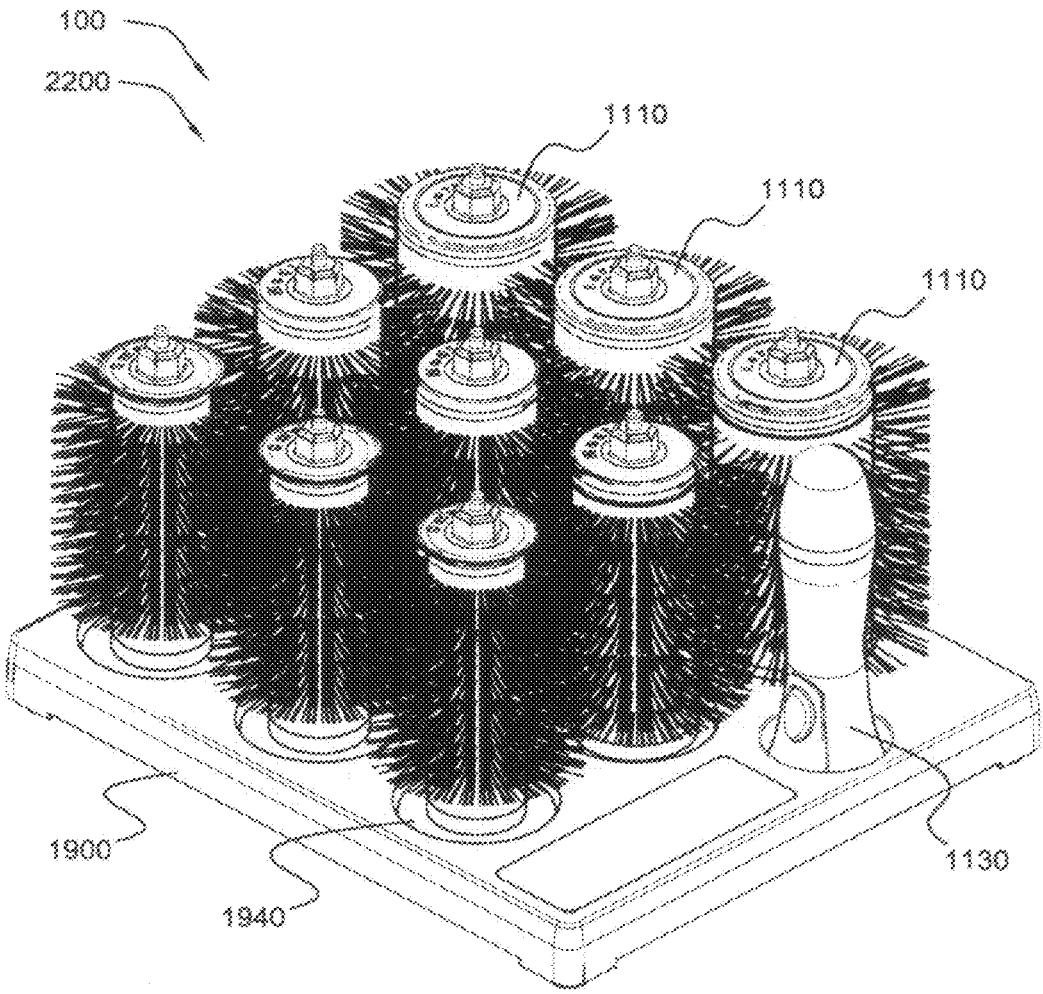
FIG. 22 shows a perspective view illustrating another kit according to a preferred embodiment of the present invention.

Brush 1110 preferably comprises connector 1114 on top end 1111, as shown. Preferably, connector 1114 comprises peg 1116, as shown. Preferably, top end 1111 and peg 1116 comprise plastic. Preferably, connector 1114 (at least embodying herein at least one first tray connector) removably attaches brush 1110 to container 1900, as shown in FIG. 22 (at least embodying herein at least one container to contain such at least one brush, wherein such at least one container comprises at least one tray, and wherein such at least one brush comprises at least one first tray connector adapted to removeably connect such at least one brush to such at least one tray). Upon reading the teachings of this specification, those with ordinary skill in the art will now understand that, under appropriate circumstances, considering such issues as advances in technology, user preference, etc., other connectors, such as slots, clips, fittings, other peg shapes, other materials, magnets, etc., may suffice.

Figure 16:
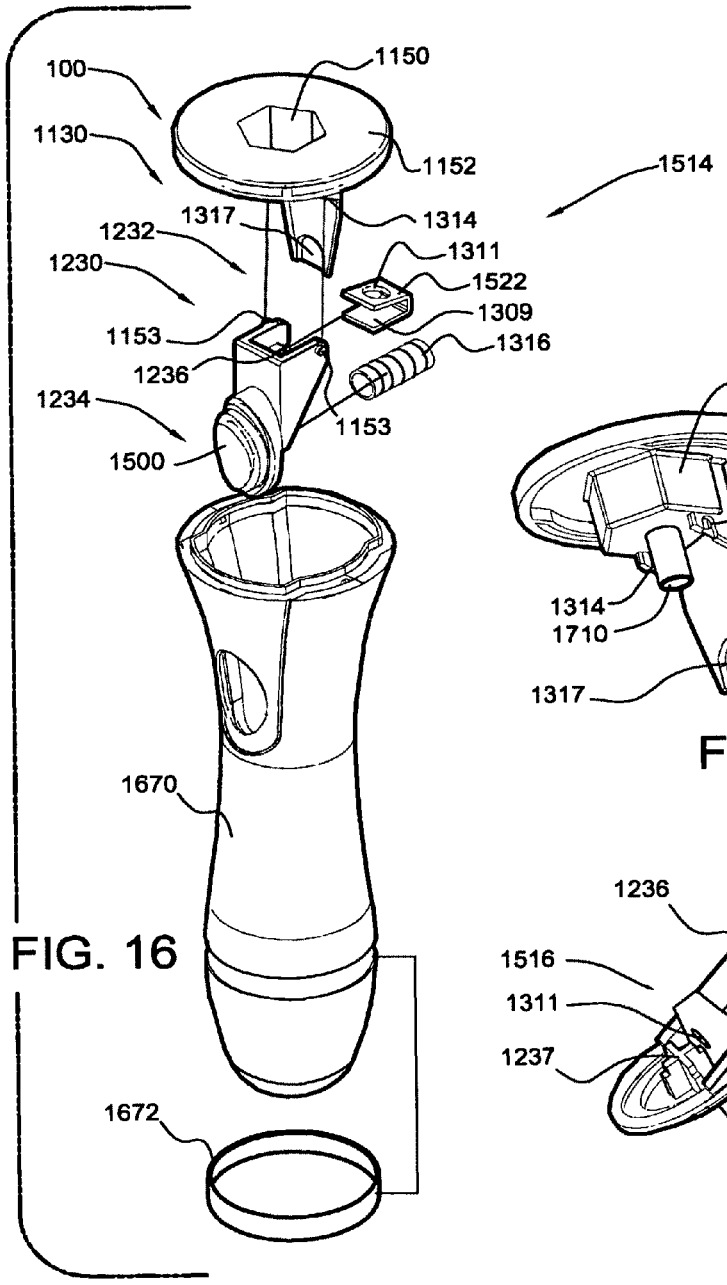
FIG. 16 shows an exploded perspective view illustrating the handle according to FIG. 11A.

FIG. 11B shows a front view illustrating hair brush 1105 according to FIG. 11A disassembled into handle 1130 and brush 1110. Preferably, handle 1130 comprises a coupler assembly identified herein as attacher 1230, as shown. Preferably, attacher 1230 (at least embodying herein at least one coupler structured and arranged to couple such at least one brush and such at least one handle) comprises quick-coupler 1232, as shown in FIG. 16. Preferably, quick-coupler 1232 comprises a decoupling assembly identified herein as quick-coupler releaser 1234 (at least embodying herein at least one decoupler structured and arranged to assist decoupling of such at least one brush from such at least one handle by the user). Preferably, quick-coupler releaser 1234 actuates quick-coupler 1232 between at least one locked position and at least one unlocked position, substantially as shown in FIGS. 3-5. Quick-coupler releaser 1234 preferably comprises a single digit-controlled button 1500 (at least embodying herein a least one digit-controlled actuator structured and arranged to allow actuation of such at least one user-controllable decoupler by at least one digit of the hand).

Digit-controlled button 1500 is preferably positioned within handle 1130 to enable such actuation by a thumb 1502 of hand 1123, as shown in FIG. 12. This preferred positioning of digit-controlled button 1500 enables the decoupling of handle 1130 from brush-head 1119 without releasing the grip of hand 1123 from handle 1130 (at least embodying herein wherein such at least one digit-controlled actuator is positioned to enable such actuation without releasing such grip of such at least one handle by the hand of the user). Upon reading the teachings of this specification, those with ordinary skill in the art will now understand that, under appropriate circumstances, considering such issues as advances in technology, user preference, etc., other handle components, such as a means for heating the brush, a means for blowing air into the brush, a means for applying styling products to the brush, etc., may suffice.

Attacher 1210 preferably comprises a two-part (male and female) assembly with the male component preferably located on bottom end 1112 of brush-head 1119 and the female component located within handle 1130, as shown. Attacher 1120 preferably comprises a rotation-blocking indexer 1140 structured and arranged to block rotation of brush-head 1119 relative to handle 1130 when the two components are coupled. Preferably, indexer 1140 comprises a two-part (male and female) assembly comprising a non-circular post 1504 having a non-circular cross-section and a matching (non-circular) indexer socket 1150 (as shown in FIG. 16) on handle cap 1152, as shown. Preferably, indexer 1140 is molded in one piece with bottom end 1112, as shown. Preferably, non-circular post 1504 is located adjacent rod 1122, as shown. Preferably, non-circular post 1504 fits into the corresponding (non-circular) indexer socket 1150 (as shown in FIG. 16) on handle cap 1152 thereby preventing axial rotation of brush 1110 on handle 1130 (at least embodying herein at least one rotation preventer structured and arranged to prevent axial rotation between such at least one handle and at least one of such plurality of brushes when such at least one of such plurality of brushes is connected to such at least one handle).

Figure 15:
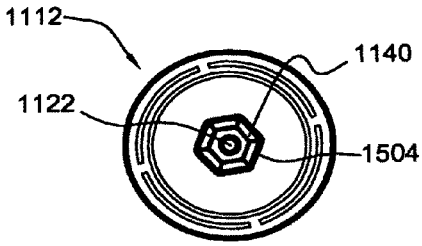
FIG. 15 shows a bottom view illustrating the brush of FIG. 11A.

Both at least one non-circular post 1504 and the non-circular indexer socket 1150 each comprises a multi-sided polygonal geometry, most preferably a hexagonal geometry, as shown. Non-circular post 1504 preferably comprises a prismatic solid having six equal sides, as shown in FIG. 15. Indexer 1140 preferably requires brush 1110 and handle 1130 to be properly rotationally aligned with each other in order for handle 1130 to be attached to brush 1110. The preferred hexagonal cross section of indexer 1140 permits the user to rotationally align handle 1130 to a stationary brush 1110 with a small twist of the user's wrist in either rotational direction (at least embodying herein wherein such at least one non-circular post is engageable within such at least one non-circular socket by rotating such at least one non-circular post to at least one position of alignment with such at least one non-circular socket). Preferably, such at least one position of alignment is achievable by a relative rotation of not more than about 60 degrees. Upon reading the teachings of this specification, those with ordinary skill in the art will now understand that, under appropriate circumstances, considering such issues as advances in technology, user preference, etc., other indexer cross-sections, such as octagonal, heptagonal, square, rectangular, oval, etc., may suffice.

Figure 13:
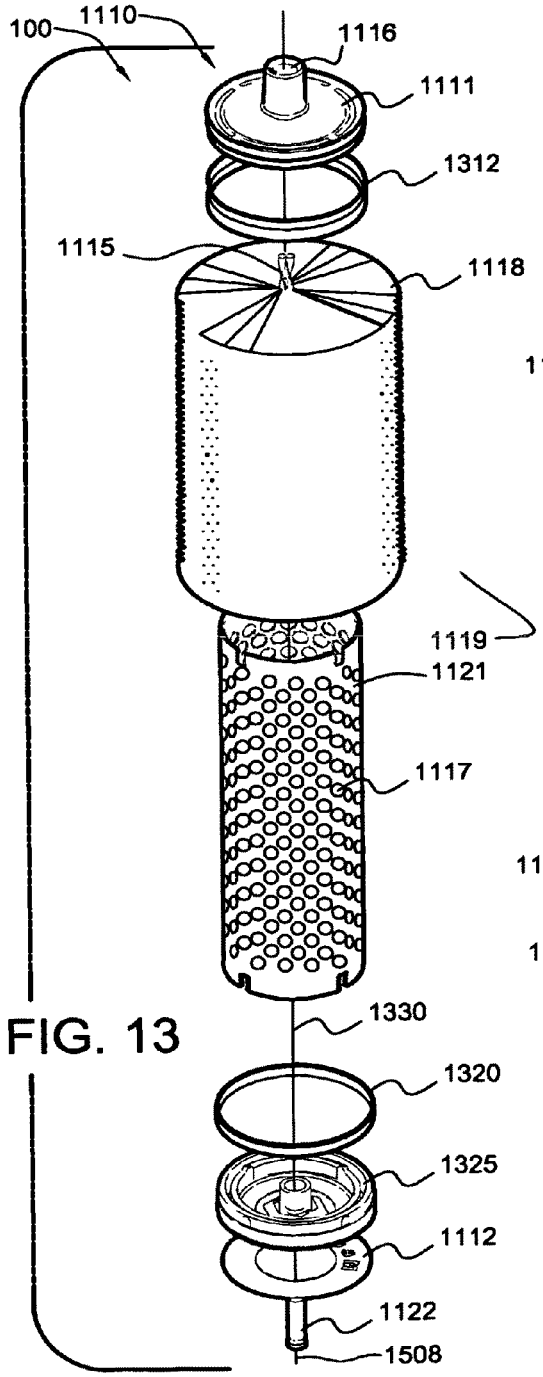
FIG. 13 shows an exploded perspective view illustrating the brush of FIG. 11A.

FIG. 13 shows an exploded perspective view illustrating brush 1110 according to FIG. 11. Preferably, brush 1110 comprises top end 1111, top connector ring 1312, bristles 1118, brush-head 1119, bottom connector ring 1320, label 1325, bottom end 1112, and rod 1122, as shown.

Preferably, bristles 1118 (shown here simplified as a cylinder) are connected to wire 1115, as shown. Preferably, wire 1115 with bristles 1118 is placed inside brush-head 1119 and is secured in place between top end 1111 and bottom. end 1112. Preferably, bristles 1118 extend through apertures 1117 in brush-head 1119, as shown in FIG. 22. Preferably, bristles 1118 comprise nylon bristles. Upon reading the teachings of this specification, those with ordinary skill in the art will now understand that, under appropriate circumstances, considering such issues as advances in technology, user preference, etc., other brush construction, such as bristles affixed to the exterior of the brush-head, bristles set into sockets, other bristle materials, etc., may suffice.

Preferably, brush-head 1119 is capped with top end 1111 and bottom end 1112, as shown. Preferably, top connector ring 1312 covers the interface between brush-head 1119 and top end 1111. Preferably, bottom connector ring 1320 covers the interface between brush-head 1119 and bottom end 1112, as shown. To assist in maintain the preferred bond between components, top connector ring 1312, bottom connector ring 1320, top end 1111, and bottom end 1112 all comprise materials having substantially similar coefficients of thermal expansion.

Preferably, rod 1122 is fixedly connected to bottom end 1112. Preferably, top end 1111, top connector ring 1312, brush-head 1119, bottom connector ring 1320, rod 1122, and bottom end 1112 are held together by the tight frictional fit between them. More preferably, top end 1111, top connector ring 1312, brush-head 1119, bottom connector ring 1320, rod 1122, and bottom end 1112 are held together by adhesive.

Preferably, label 1325 provides a visual indicator of the size of brush 1110. Preferably, label 1325 comprises a disc of paper, plastic, metal, etc., imprinted with a size indicator. Upon reading the teachings of this specification, those with ordinary skill in the art will now understand that, under appropriate circumstances, considering such issues as advances in technology, user preference, etc., other size indicators, such as no size indicator, embossing the size indicator onto the bottom end and/or the top end, color coding the brush to indicate size, etc., may suffice.

Figure 14:
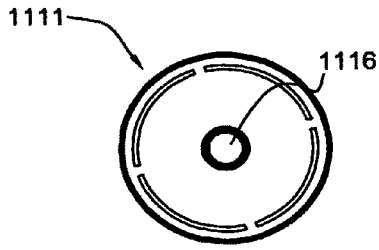
FIG. 14 shows a top view illustrating the brush of FIG. 11A.

FIG. 14 shows a top view illustrating brush 1110 according to FIG. 11A with a portion of bristles 1118 omitted from the view. FIG. 15 shows a bottom view illustrating brush 1110 according to FIG. 11A with a portion of bristles 1118 omitted from the view for clarity. FIG. 16 shows an exploded perspective view illustrating handle 1130 according to FIG. 11. Preferably, attacher 1210 and attacher 1230 together comprise attacher 1300.

Rod 1122 preferably comprises longitudinal axis 1508 and circumferential groove 1510, as shown. Preferably, rod 1122 comprises metal. Rod 1122 preferably comprises an integral component of attacher 1120. Preferably, attacher 1210 attaches to attacher 1230, substantially as shown in FIG. 4.

Thus, attacher 1120 further preferably comprises rod-receiving bore 1512 structured and arranged to receive rod 1122, as shown. Rod-receiving bore 1512 is preferably located within handle 1130, as shown. Rod-receiving bore 1512 is preferably located substantially coaxially with indexer socket 1150.

Attacher 1120 preferably comprises keeper assembly 1514 structured and arranged to keep rod 1122 in at least one position of engagement within rod-receiving bore 1512. Keeper assembly 1514 preferably comprises at least one groove engager 1516 structured and arranged to engage circumferential groove 1510 to prevent axial movement of rod 1122 parallel to longitudinal axis 1508 (away from rod-receiving bore 1512).

Keeper assembly 1514 preferably comprises groove engager 1516, fulcrum 1314, spring 1316, and digit-controlled button 1500, as shown. Preferably, handle cap 1152 comprises fulcrum 1314, as shown. Groove engager 1516 preferably comprises an interior circumferential surface of aperture 1311 (see FIG. 16).

Preferably, groove engager 1516 is rotatably connected to handle cap 1152 at fulcrum 1314 by hinges 1153, as shown. Groove engager 1516 is preferably joined to digit-controlled button 1500, as shown, through bonding, or alternately preferably integral molding. Spring 1316 is preferably adapted to bias groove engager 1516 toward circumferential groove 1510. Groove engager 1516 preferably rotates about fulcrum 1314 when digit-controlled button 1500 is pressed. Upon reading the teachings of this specification, those with ordinary skill in the art will now understand that, under appropriate circumstances, considering such issues as advances in technology, user preference, ease of manufacturing, etc., other quick-coupler mechanisms may suffice.

Aperture 1311 forming groove engager 1516 is preferably sized and shaped to allow movement about rod 1122. Preferably, rod 1122 is about one-eighths inch in diameter. Preferably, aperture 1311 is slightly larger than one-eighths inch in diameter. Preferably, rod 1122 is substantially circular, as shown in FIG. 15. Preferably, aperture 1311 is substantially circular. Upon reading the teachings of this specification, those with ordinary skill in the art will now understand that, under appropriate circumstances, considering such issues as advances in technology, user preference, etc., other arrangements, such as the aperture comprising a slot, the aperture comprising a hole placed longitudinally into the end of a lever, the rod and aperture being rotationally indexed, other rod diameters, other aperture diameters, etc., may suffice.

Preferably, when digit-controlled button 1500 is compressed groove engager 1516 is moved into an unlocked position, substantially away from circumferential groove 1510, as shown in FIG. 3. Preferably, when digit-controlled button 1500 of quick-coupler releaser 1234 is compressed, aperture 1311 is moved into an alignment approximately perpendicular to rod 1122, whereby rod 1122 is removable from aperture 1311 without binding, substantially as shown in FIG. 3.

The distal end of rod 1122 preferably comprises a circumferential ramp 1530, as shown. Groove engager 1516 is preferably adapted to move aperture 1311 into the alignment approximately perpendicular to rod 1122 when contacting ramp 1530, such as during insertion of rod 1122. This preferred arrangement preferably functions as an automatic engager to automatically engage groove engager 1516 on rod 1122, preferably without the user pressing digit-controlled button 1500.

When the distal end of rod 1122 passes through aperture 1311, spring 1316 preferably urges the interior circumferential surface of aperture 1311 toward the preferred interlocked position with circumferential groove 1510, substantially as shown in FIG. 4. Preferably, spring 1316 comprises a metal coil spring. Preferably, spring 1316 is held between digit-controlled button 1500 and fixture 1317 on handle cap 1152, as shown.

Preferably, handle 1130 comprises housing 1670, as shown. Preferably, housing 1670 is molded in two pieces which are fitted together lengthwise during assembly. Preferably, handle 1130 comprises ring 1672, as shown. Preferably, ring 1672 assists in holding housing 1670 together.

Figure 17:
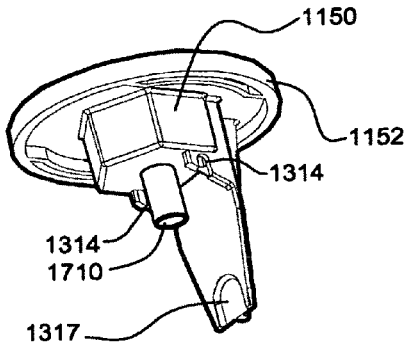
FIG. 17 shows a perspective view illustrating the handle cap according to the preferred embodiment of FIG. 16.

FIG. 17 shows a perspective view illustrating handle cap 1152 according to the preferred embodiment of FIG. 16. Preferably, handle cap 1152 comprises aperture 1710, as shown. Preferably, aperture 1710 permits rod 1122 to pass through handle cap 1152 to groove engager 1516.

Figure 18:
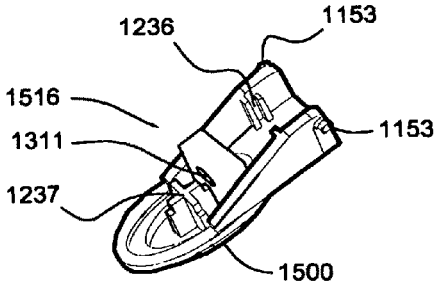
FIG. 18 shows a perspective view illustrating a quick-connect actuator according to the preferred embodiment of FIG. 16.

FIG. 18 shows a perspective view illustrating the underside of digit-controlled button 1500 of quick-coupler releaser 1234, according to the preferred embodiment of FIG. 16. Preferably, spring 1316 fits over and is held by fixture 1237. Upon reading the teachings of this specification, those with ordinary skill in the art will now understand that, under appropriate circumstances, considering such issues as advances in technology, user preference, manufacturing considerations, intended use, etc., other attachers, such as hook and loop fasteners, magnets, other clamps, friction fittings, other rotationally indexed connectors, other types of actuators, etc., may suffice.

Figure 19:
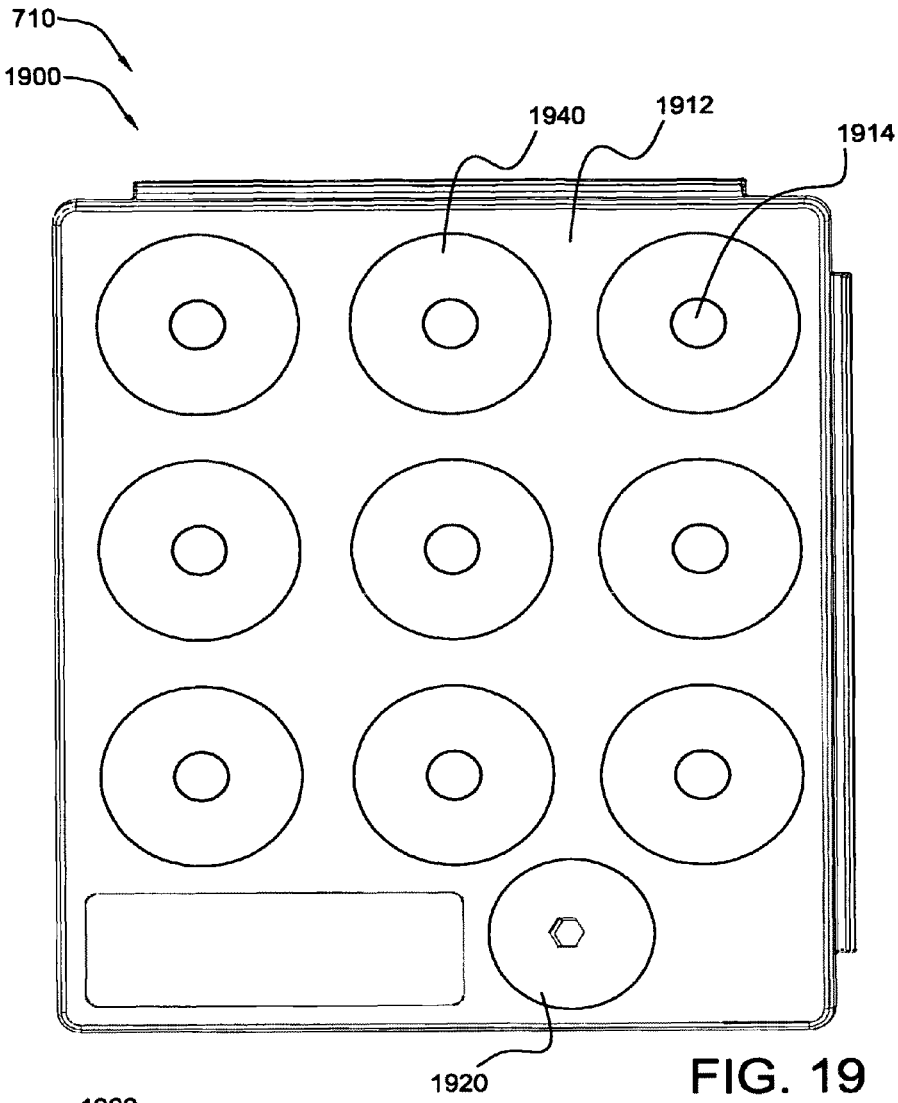
FIG. 19 shows a top view illustrating a storage tray according to a preferred embodiment of the present invention.

FIG. 19 shows a top view illustrating storage tray 1900 according to the preferred embodiment of the present invention. Preferably, container 710 comprises storage tray 1900 (at least embodying herein wherein such at least one container comprises at least one tray), as shown. Preferably, storage tray 1900 (at least embodying herein wherein such at least one container comprises at least one tray) comprises interior 1912, as shown. Preferably, interior 1912 comprises holes 1914 (at least embodying herein wherein such at least one container comprises a plurality of holes), as shown. Preferably, holes 1914 are adapted to friction-fit onto connectors 1114 (preferably comprising pegs 1116 (at least embodying herein wherein such at least one container connector comprises at least one peg adapted to fit connectively into at least one of such plurality of holes)). Preferably, pegs 1116 are inserted into holes 1914 in order to conveniently hold brushes 1110 in storage tray 1900, as shown in FIG. 22. Preferably, storage tray 1900 comprises plastic.

Optional recesses 1940 adjacent holes 1914 permit brushes 1110 to be more deeply set into storage tray 1900, as shown in FIG. 22.

Preferably, storage tray 1900 comprises slot 1920, as shown. Preferably, slot 1920 is adapted to friction-fit handle 1130. Preferably, handle 1130 is inserted into slot 1920 for storage. Upon reading the teachings of this specification, those with ordinary skill in the art will now understand that, under appropriate circumstances, considering such issues as advances in technology, user preference, etc., other storage arrangements, such as a stand, a bag, etc., may suffice.

Figure 20:
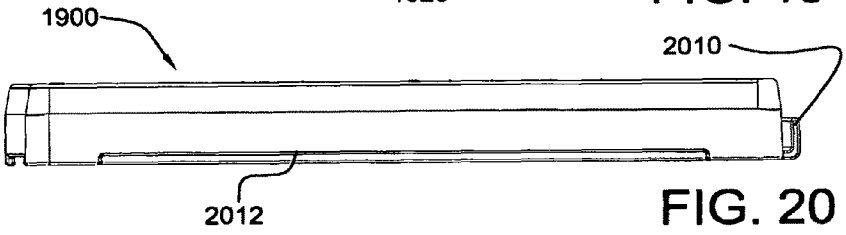
FIG. 20 shows a front view illustrating the storage tray according to the preferred embodiment of FIG. 19.
Figure 21:
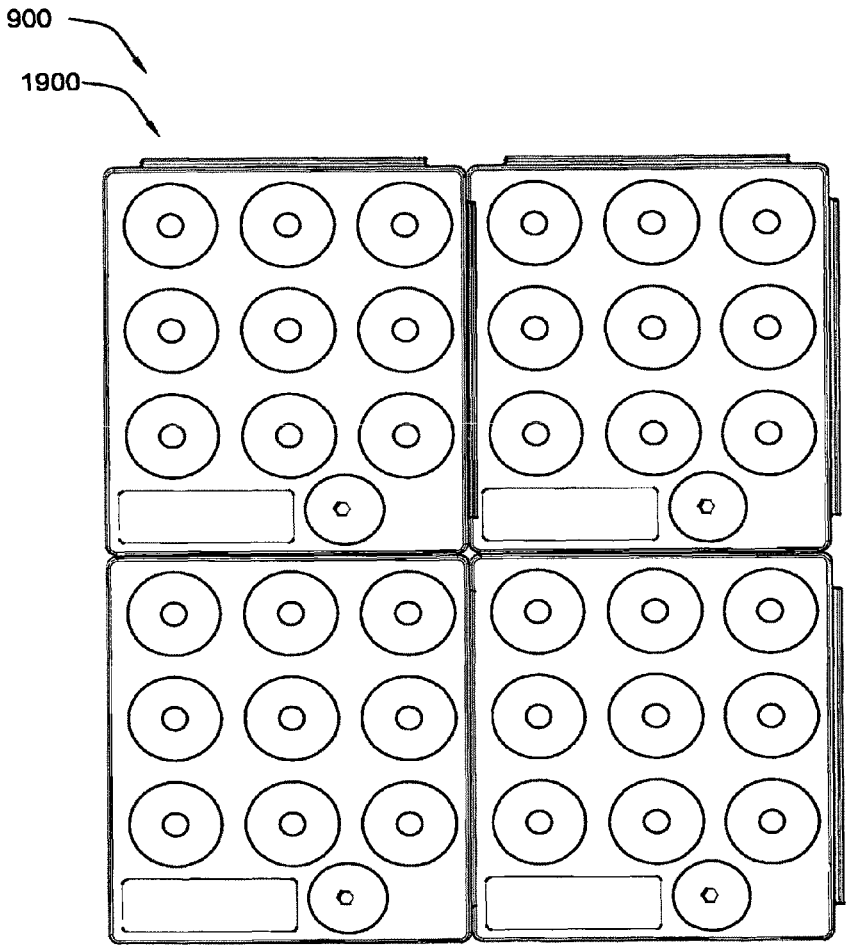
FIG. 21 shows a top view illustrating a plurality of storage trays according to the preferred embodiment of FIG. 19 in an interlocking array.

FIG. 20 shows a front view illustrating storage tray 1900 according to the preferred embodiment of FIG. 19. Preferably, storage tray 1900 comprises tray connectors 2010 (at least embodying herein wherein a plurality of such at least one trays are structured and arranged to interlock with each other), as shown. Preferably, tray connectors 2010 permit a plurality of storage trays 1900 to be connected to each other side-by-side, as shown in FIG. 21. Preferably, tray connectors 2010 clip under an edge 2012 of another storage tray 1900. Preferably, tray connectors 2010 releasably attach a plurality of storage trays 1900 to each other. Upon reading the teachings of this specification, those with ordinary skill in the art will now understand that, under appropriate circumstances, considering such issues as advances in technology, user preference, etc., other tray connectors, such as locking tray connectors, stacking tray connectors, adhesive connectors, etc., may suffice.

FIG. 21 shows a top view illustrating a plurality of storage trays 1900 according to the preferred embodiment of FIG. 19 in an interlocking array. Preferably, any number of storage trays 1900 can be connected together for the convenience of the end-user or to form point-of-sale displays. Preferably, point-of-sale display 900 further comprises a plurality of interlocked storage trays 1900, as shown.

FIG. 22 shows a perspective view illustrating another hairbrush kit 2200 according to the preferred embodiment of the present invention. Preferably, hair brush system 100 comprises hairbrush kit 2200, as shown. Preferably, kit 2200 comprises at least one storage tray 1900 (at least embodying herein at least one container adapted to contain such plurality of brushes and such at least one handle), at least one handle 1130, as shown. Upon reading the teachings of this specification, those with ordinary skill in the art will now understand that, under appropriate circumstances, considering such issues as advances in technology, user preference, etc., other kit components, such as instructions, packaging, hair accessories, styling products, etc., may suffice.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A hair brush system comprising:

a first storage tray having a plurality of recesses; a handle comprising a single-button release mechanism configured to be actuated without releasing the handle and a rod-receiving bore at an end of the handle configured to receive a rod of a brush head; and a plurality of uniformly-sized removable brush heads configured to attach to the handle one at a time, each brush head comprising the rod configured to mate with the rod-receiving bore at the end of the handle, wherein each removable brush head further comprises a connector attached to a top end of the removable brush head, and a peg extending outwardly from a top end of the connector, the peg having a shape complimentary to one of the recesses in the first storage tray when each removable brush head is detached from the handle, wherein the connector of each removable brush heads sit above a top surface of the first storage tray when the peg is mated to the first storage tray; and a rotation-blocking indexer structured and arranged to block rotation of brush-head relative to handle when the brush head and the handle are coupled, the rotation-blocking indexer having a larger diameter than the rod, wherein each removable brush head comprises a perforated hollow cylindrical barrel and a plurality of bristles extending outwardly from the barrel, the barrel comprising ceramic material and wherein each removable brush head is configured to detach from the handle when the release mechanism is actuated.

2. The hair brush of claim 1, wherein the handle further comprises:

a first end;

a second end opposite the first end; and a grippable surface disposed between the first end and the second end.

3. The hair brush of claim 2, wherein the handle further comprises a non-circular indexer socket extending into the first end.

4. The hair brush of claim 3, wherein each removable brush head further comprises:

a bottom end; and the rotation-blocking indexer includes a non-circular post extending from the bottom end, wherein the non-circular indexer socket is configured to receive the non-circular post and is configured to prevent each brush head from rotating relative to the handle.

5. The hair brush of claim 1, wherein an edge of the first storage tray is configured to mate to an edge of a second storage tray.

6. The hair brush of claim 1, wherein the hair brush is 7 inches in length.

7. The hair brush of claim 1, wherein each removable brush head is 4 inches in length.

8. The hair brush of claim 1, wherein each removable brush head is 1 to 1.5 inches in diameter.

9. A hair brush kit comprising:

a storage tray having a plurality of recesses; a handle comprising a single-button release mechanism configured to be actuated without releasing the handle and a rod-receiving bore at an end of the handle configured to receive a brush head; and a plurality of uniformly-shaped removable brush heads, each of the removable brush heads configured to attach to the handle one at a time, each brush head comprising a rod configured to mate with the rod-receiving bore at the end of the handle, wherein each removable brush head from the plurality of removable brush heads comprises a connector attached to a top end of each removable brush head and a peg extending outwardly from a top end of the connector, the peg having a shape complimentary to one of the recesses in the storage tray when each removable brush head is detached from the handle, wherein the connector of each removable brush head sits above a top surface of the storage tray when the peg is mated to the storage tray; and a rotation-blocking indexer structured and arranged to block rotation of brush-head relative to handle when the brush head and the handle are coupled, the rotation-blocking indexer having a larger diameter than the rod, wherein each removable brush head from the plurality of removable brush heads comprises a perforated hollow cylindrical barrel and a plurality of bristles extending outwardly from each barrel, and wherein each barrel is comprised of ceramic material and wherein each removable brush head is configured to detach from the handle when the release mechanism is actuated.

10. The hair brush kit of claim 9, wherein the handle further comprises:

a first end;

a second end opposite the first end; and a grippable surface disposed between the first end and the second end.

11. The hair brush kit of claim 10, wherein the handle further comprises a non-circular indexer socket extending into the first end.

12. The hair brush kit of claim 11, wherein each removable brush head from the plurality of removable brush heads further comprises:

a bottom end; and the rotation-blocking indexer includes a non-circular post extending from the bottom end, the non-circular indexer socket configured to receive the non-circular post and configured to prevent each brush head from rotating relative to the handle.

13. The hair brush kit of claim 9, wherein an edge of the first storage tray is configured to mate to an edge of a second storage tray.

14. The hair brush kit of claim 9, wherein the length of the handle attached to one of the plurality of removable brush heads is 7 inches in length.

15. The hair brush kit of claim 9, wherein each removable brush head from the plurality of removable brush heads is 4 inches in length, and wherein each removable brush head is 1 to 1.5 inches in diameter.

16. A hair brush system comprising:

a storage tray having a plurality of recesses; a handle comprising:

a first end;

a second end opposite the first end;

a grippable surface disposed between the first end and the second end;

a non-circular indexer socket extending into the first end;

a rod-receiving bore at an end of the handle configured to receive a rod of a brush head, the indexer having a larger diameter than the rod; and a one button release mechanism disposed within the handle configured to be actuated without releasing the handle; and a brush head comprising:

a top end;

a bottom end opposite the top end;

a hollow cylindrical surface disposed between the top end and the bottom end;

a plurality of holes in the hollow cylindrical surface;

a plurality of bristles extending outwardly from the plurality of holes;

a ceramic coating on the hollow cylindrical surface;

a connector attached to the top end;

a peg extending from a top end of the connector and having a shape complimentary to one of the recesses in the storage tray when the brush head is detached from the handle, wherein the connector of each removable brush head sits above a top surface of the storage tray when the peg is mated to the storage tray;

a non-circular post extending from the bottom end; and the rod extending from the non-circular post configured to mate with the rod-receiving bore at the end of the handle, wherein the bottom end of the brush head is removably attached to the first end of the handle, and wherein the non-circular indexing socket is configured to receive the non-circular post and configured to prevent the brush head from rotating relative to the handle.

17. The hair brush of claim 9, wherein the peg extends from a center portion of the connector.

* * * * *